US012083585B2

(12) United States Patent
Becker et al.

(10) Patent No.: US 12,083,585 B2
(45) Date of Patent: Sep. 10, 2024

(54) COOLING PAD ASSEMBLY FOR A BELT CASTING SYSTEM

(71) Applicant: Novelis Inc., Atlanta, GA (US)

(72) Inventors: Heinz Becker, Kingston (CA); Edward S. Luce, Kingston (CA); Kevin M. Gatenby, Commerce Township, MI (US); Dennis P. Chadwick, Kingston (CA); Simon William Barker, Spokane, WA (US)

(73) Assignee: Novelis Inc.

( * ) Notice: Subject to any disclaimer, the term of this patent is extended or adjusted under 35 U.S.C. 154(b) by 0 days.

(21) Appl. No.: 18/257,391

(22) PCT Filed: Feb. 3, 2022

(86) PCT No.: PCT/US2022/070491
§ 371 (c)(1),
(2) Date: Jun. 14, 2023

(87) PCT Pub. No.: WO2022/170329
PCT Pub. Date: Aug. 11, 2022

(65) Prior Publication Data

US 2024/0017321 A1 Jan. 18, 2024

Related U.S. Application Data

(60) Provisional application No. 63/199,962, filed on Feb. 5, 2021.

(51) Int. Cl.
*B22D 11/06* (2006.01)
*B22D 11/124* (2006.01)

(52) U.S. Cl.
CPC ..... *B22D 11/1246* (2013.01); *B22D 11/0605* (2013.01); *B22D 11/0685* (2013.01)

(58) Field of Classification Search
CPC ..... B22D 11/0605; B22D 11/0637; B22D 11/0654; B22D 11/0685; B22D 11/1246
See application file for complete search history.

(56) References Cited

U.S. PATENT DOCUMENTS

| | | | | |
|---|---|---|---|---|
| 4,193,440 A * | 3/1980 | Thorburn | B22D 11/0677 | 164/432 |
| 8,176,970 B2 * | 5/2012 | Ito | B22D 11/0685 | 164/443 |
| 8,662,145 B2 * | 3/2014 | Gatenby | B22D 11/0677 | 164/432 |

FOREIGN PATENT DOCUMENTS

| | | |
|---|---|---|
| EP | 2741873 A1 | 6/2014 |
| WO | 0211922 A2 | 2/2002 |

OTHER PUBLICATIONS

PCT/US2022/070491, "International Search Repon and Written Opinion", Jun. 21, 2022, 18 pages.

(Continued)

*Primary Examiner* — Kevin E Yoon
(74) *Attorney, Agent, or Firm* — Kilpatrick Townsend & Stockton LLP

(57) ABSTRACT

A cooling pad for a belt casting system includes a first nozzle arrangement and a second nozzle arrangement. In some embodiments, the first nozzle arrangement includes an elongated nozzle assembly that includes a base defining a receiving area, a first insert positionable within the receiving area, and a second insert positionable within the receiving area. The first insert and the base together define a first elongated dispensing slot. The second insert is adjustable relative to the first insert, and the second insert and the base together define a second elongated dispensing slot. In various embodiments, the second nozzle arrangement includes a plurality of multi-position nozzles, each movable between a base position and an offset position such that the heat (Continued)

transfer rate may be locally controlled across the cooling cavity.

5 Claims, 21 Drawing Sheets

(56) References Cited

OTHER PUBLICATIONS

PCT/US2022/070491, "Invitation to Pay Additional Fees and, Where Applicable, Protest Fee", Apr. 29, 2022, 11 pages.
PCT/US2022/070491, "International Preliminary Report on Patentability", Aug. 17, 2023, 12 pages.

* cited by examiner

COOLING PAD ASSEMBLY FOR A BELT CASTING SYSTEM

REFERENCE TO RELATED APPLICATION

This application claims the benefit of U.S. Provisional Patent Application No. 63/199,962, filed on Feb. 5, 2021 and entitled COOLING PAD ASSEMBLY FOR A BELT CASTING SYSTEM, the content of which is hereby incorporated by reference in its entirety.

FIELD OF THE INVENTION

This application relates to belt casting systems, and, more particularly, to cooling pad assemblies for belt casting systems.

BACKGROUND

A metal product may be produced by continuous casting systems such as belt casting systems, rotating block casting systems, twin roll casting systems, etc. Belt casting systems generally include endless belts that are driven over rollers and/or other supports as desired, and each endless belt has a casting surface and a rear surface opposite from the casting surface. The belts define a casting cavity that is formed between confronting sections of the casting surfaces of the belts as the belts are driven in a casting direction. Molten metal is continuously introduced into an inlet end of the casting cavity via an injector or other feed device, and the metal is cooled as it passes through the casting cavity, to emerge as a continuous metal product of desired thickness. In particular, heat is withdrawn from the metal in the casting cavity by and through the casting surfaces so that the metal cools and produces a solid metal product having a thickness similar to the spacing between the casting surfaces. Side dams are usually provided between the casting surfaces at their extreme lateral edges to prevent loss of metal and to define the side edges of the casting cavity. The casting surfaces are continuously recirculated externally of the casting cavity from the outlet to the inlet so that they are continuously available for use.

The casting surfaces are generally actively cooled so that they are capable of withdrawing heat from the metal in the casting cavity and to provide the metal product with the desired properties. In some cases, the casting surfaces are cooled with a coolant, such as a cooling liquid or gas. For example, a continuous flow of cooling liquid (usually water containing appropriate additives) is applied to the rear surfaces of the recirculating endless belts in the regions where the belts confront each other to form the casting cavity so that heat is extracted from the casting cavity through the casting surfaces and the belts and is removed by the coolant. The coolant may then be withdrawn after it has provided the desired cooling effect. While such cooling systems may provide cooling, they have a limited ability to control the casting condition, and such cooling systems may have difficulty during the casting of thinner metal products and/or metals of a long freezing range to achieve good surface and internal quality as well as solidification within the mold.

SUMMARY

Embodiments covered by this patent are defined by the claims below, not this summary. This summary is a high-level overview of various embodiments and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

According to certain embodiments, a cooling pad assembly for a belt casting system includes an elongated nozzle assembly. The elongated nozzle assembly includes a base, a first insert, and a second insert. The base defines a receiving area, and the first insert and the second insert are each positionable within the receiving area. The first insert and the base together define a first elongated dispensing slot, and the second insert and the base together define a second elongated dispensing slot that is offset from the first elongated dispensing slot in a longitudinal direction. The cooling pad is configured to dispense a coolant through each of the first elongated dispensing slot and the second elongated dispensing slot. In various embodiments, first insert is independently adjustable relative to the second insert within the receiving area.

According to various embodiments, a cooling pad assembly for a belt casting system includes a nozzle arrangement having a plurality of multi-position nozzles that dispense a coolant. Each multi-position nozzle includes a stem and a cap that is rotatably and longitudinally movable along the stem between a base position and an offset position. The cap includes a dispensing end. In various embodiments, in the base position, the dispensing end is arranged in a cooling pad nozzle plane relative to a central plane of a casting cavity of the belt casting system, and, in the offset position, the dispensing end is offset by a distance from the cooling pad nozzle plane and away from the central plane.

According to some embodiments, a cooling pad assembly for a belt casting system includes a support assembly and a nozzle arrangement supported on the support assembly. The support assembly includes a chamber that stores a supply of a coolant, a plurality of supply passages in fluid communication with the chamber and extending in a vertical direction, and a plurality of drainage passages extending in the vertical direction. In various embodiments, each drainage passage of the plurality of drainage passages is longitudinally and laterally offset from an adjacent supply passage of the plurality of supply passages. The nozzle arrangement includes at least one dispensing aperture and at least one drainage aperture. In certain embodiments, the at least one dispensing aperture is in fluid communication with at least one supply passage of the plurality of supply passages, and the at least one drainage aperture is in fluid communication with at least one drainage passage of the plurality of drainage passages.

Various implementations described herein can include additional systems, methods, features, and advantages, which cannot necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The specification makes reference to the following appended figures, in which use of like reference numerals in different figures is intended to illustrate like or analogous components.

DETAILED DESCRIPTION

Figure 1:
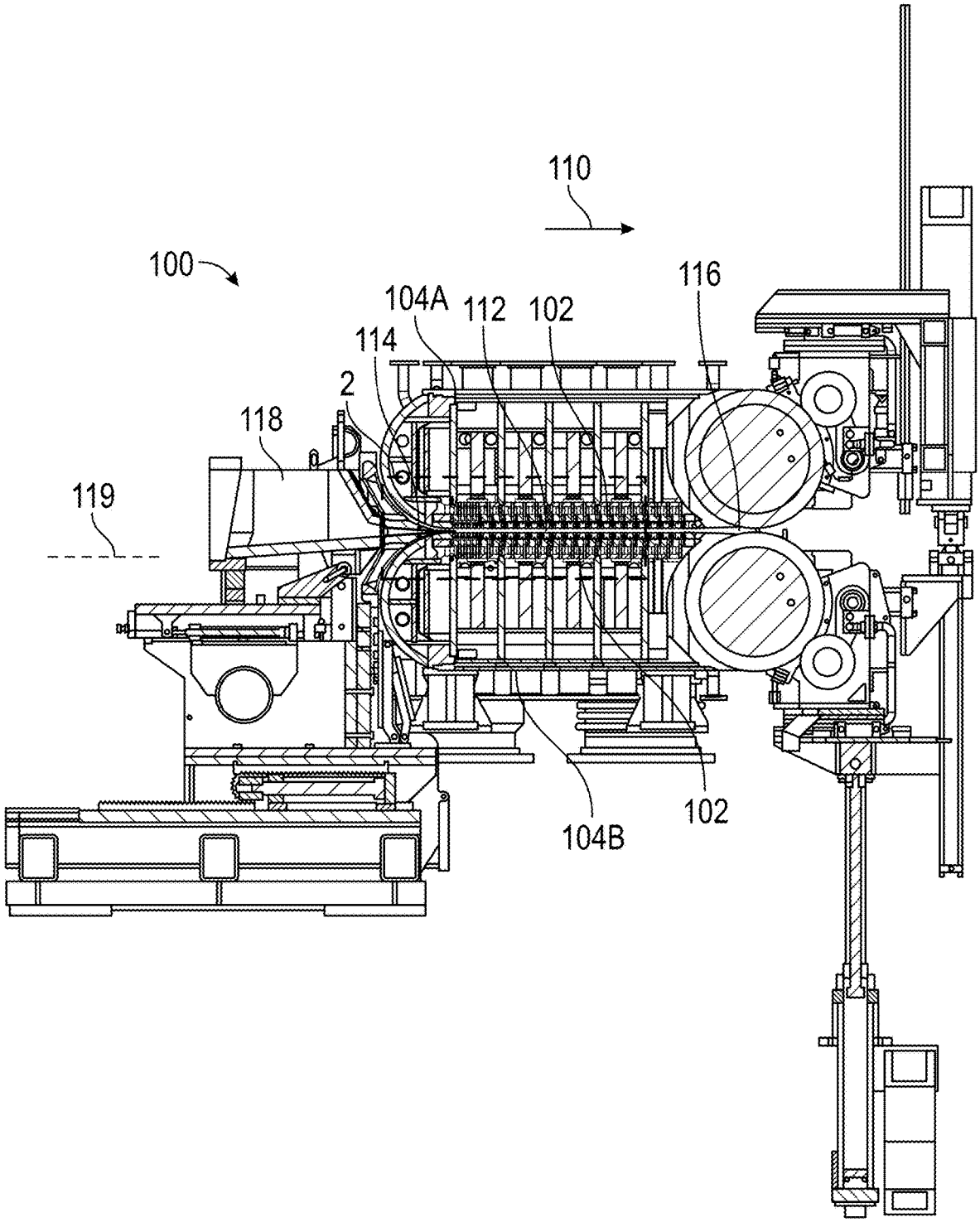
FIG. 1 is a sectional view of a casting system according to embodiments.

The subject matter of embodiments of the present disclosure is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. Directional references such as "longitudinal," "lateral," "vertical," "up," "down," "top," "bottom," "left," "right," "front," and "back," among others, are intended to refer to the orientation as illustrated and described in the figure (or figures) to which the components and directions are referencing.

As used herein, an "X" axis identifies the "pass line direction" that the process material (e.g., metal product) travels. The "X" axis may also be referred to as the longitudinal direction or the downstream direction The "Y" axis identifies the "cross-width direction" of the process material product. The "Y" axis is horizontally perpendicular to the pass line direction (or "X" axis), and may also be referred to as the transverse direction or the lateral direction. The "Z" axis identifies the direction perpendicular to the "X" axis and the "Y" axis. The "Z" axis defines the horizontal orientation of the "X-Y" plane, and may also be referred to as the vertical direction or the up/down direction.

Described herein is a cooling system for belt casting systems, including but not limited to twin belt casting systems. A twin belt casting system may generally include an upper carriage having a first endless belt and a lower carriage having a second endless belt. The upper carriage and the lower carriage together may define a casting cavity. The metal product produced by such systems may be various suitable metals, although such systems may be particularly suitable for metals including, but not limited to, aluminum and aluminum alloys.

In various embodiments, the cooling system may include at least one cooling pad assembly, and in certain embodiments, the cooling system includes at least two cooling pad assemblies. Each cooling pad assembly selectively provides a coolant to an internal surface of an endless belt (i.e., the surface opposite from the casting surface of the endless belt) such that the casting surface is actively cooled to withdraw heat from the metal in the casting cavity. In various aspects, each cooling pad assembly supplies the coolant to the internal rear surface of the endless belt in the region where the endless belt partially forms the casting cavity. Each cooling pad assembly is comprised of a number of cooling pad modules. Each cooling pad module may have any number of nozzle types, assemblies and configurations depending on its location and function in the overall cooling system. The cooling pad modules described herein generally include a first nozzle arrangement and a second nozzle arrangement.

In a twin belt casting system, each endless belt may have one or more cooling pad assemblies. In various embodiments, one cooling pad assembly may be an upper carriage cooling pad assembly that extracts heat from the top of the casting cavity, and another cooling pad assembly may be a lower carriage cooling pad assembly that extracts heat from the bottom of the casting cavity. In certain embodiments, each caster carriage cooling pad assembly defines its own cooling pad nozzle plane by the outer surface of the first nozzle arrangement facing the caster cavity. The outer surface of the second nozzle arrangement may be set such that one or more portions of the outer surface of the second nozzle arrangement are coplanar with the cooling pad nozzle plane or non-coplanar with cooling pad nozzle plane. In various embodiments, the upper carriage is vertically adjustable up and down to set the casting slab thickness, and it may also be tilted about the "Y" axis to either converge or diverge with respect to the lower carriage. As such, the cooling pad nozzle plane of the upper carriage may or may not be parallel to the cooling pad nozzle plane of the lower carriage during casting.

The first nozzle arrangement includes at least one elongated nozzle assembly. The elongated nozzle assembly includes a base, a first insert, and a second insert. The base defines a receiving area, and the first insert and the second insert are each positionable within the receiving area. In certain embodiments, the first insert and the base together form a first elongated dispensing slot, and the second insert and the base together form a second elongated dispensing slot that is offset from the first elongated dispensing slot. The first elongated dispensing slot may be parallel to the second elongated dispensing slot, although it need not be in other embodiments. In certain aspects, the first elongated dispensing slot and/or the second elongated dispensing slot may be perpendicular to the pass line direction, although they need not be in other embodiments. In various embodiments, each insert can be independently positioned and adjusted to fine tune a dimension of its elongated dispensing slot without influencing the other elongated dispensing slot in the same base. The first insert and the second insert together form an elongated drainage slot. There may be several linear nozzle assemblies mounted in any combination on any of the cooling pad modules to meet the process production objectives.

The second nozzle arrangement is downstream from the first nozzle arrangement in a pass line direction and includes a plurality of multi-position nozzles. Each multi-position nozzle includes a stem and a cap that is rotatably and longitudinally movable along the stem between a base position and an offset position. In the base position, a dispensing end of the cap is arranged in the cooling pad nozzle plane. In the offset position, the dispensing end is offset from the cooling pad nozzle plane. While two positions of the nozzles are discussed, in other embodiments, the nozzles may actuate over a range of heights and are not limited to two positions.

In some embodiments, each cap may be hexagonal, although in other embodiments, one or more caps of the second nozzle arrangement may have other shapes as desired. Each cap may include a dispensing orifice. In certain embodiments, the cap of each multi-position nozzle may include one or more pins that are axially and rotationally movable along a pair of grooved guideways in the stem to a first end or a second end of the grooved guideways. A vertical groove of the grooved guideways may provide a path for installing and removing the cap from the stem. When the cap is rotated to the first position, it is spring loaded into the base position, which may be a nominal operating position. In this position the surface of the dispensing end of the cap is coplanar with the outer surface of the elongated nozzle assembly and in the cooling pad nozzle plane. Rotating the cap to the second position places the cap in the depressed position, which may be a nominal non-operating position. In this position the surface of the dispensing end of the cap is offset away from the cooling pad nozzle plane and farther away from the internal surface of the endless belt. As mentioned, in other embodiments, the cap may be actuated over a range of heights that may include two or more positions. As such, the reference to the first position and the second position should not be considered limiting.

In various embodiments, one or more of the caps may include a position indicator that indicates whether a particular cap is in the base position or the offset position. In some embodiments, the position indicator may be a clipped tip or corner of the cap, although various other suitable types of position indicators may be utilized as desired. In one non-limiting embodiment, the position indicator may include two clipped tips or corners. In some embodiments, the position indicators may be aligned with the pins of the cap. In one non-limiting example, when the multi-position nozzle is in the base position, the position indicators may be in alignment with the pass line direction, and when the hexagonal nozzle is in the non-operating, depressed position, the position indicators may be rotated out of alignment with the pass line direction. In some embodiments, the position indicators may be rotated 60° out of alignment with the pass line direction, although various other angles may be utilized in other embodiments. The position indicators in or out of alignment with the pass line direction may provide a caster operator with a quick visual indication of which nozzles are in the depressed, non-operating position, and which nozzles are in the base position.

According to various embodiments, each cooling pad module for a belt casting system includes a base. The base may have mounting surfaces for supporting the various cooling nozzle assembly types and optionally for other casting components, including but not limited to casting belt guidance components. The base also includes a plenum chamber configured to store a supply of a coolant, a plurality of supply passages in fluid communication with the plenum chamber and extending in a vertical direction, and a plurality of drainage passages extending in the vertical direction. In certain embodiments, each drainage passage of the plurality of drainage passages is longitudinally and laterally offset from an adjacent supply passage of the plurality of supply passages. In some embodiments, the coolant supply passages may be arranged in an intricate grid to uniformly direct coolant from the plenum chamber to the various nozzle assemblies which in turn project coolant to the internal surface of the cooling belt. The coolant drainage passages project vertically through the plenum chamber to the back side of the cooling pad module to direct the coolant away from the internal surface of the casting belt. In various aspects, at least one drainage passage is in fluid communication with the elongated drainage slot. In certain embodiments, the network of supply and return passages are offset from each other in an integrated matrix to optimize flow uniformity and minimize flow restrictions.

The cooling pad assemblies and modules described herein may improve the coolant flow regime during casting. In some cases, the supply chambers in the elongated nozzle assemblies have an increased volume that may improve the uniformity of the coolant flow. In addition, the drainage passages directing coolant away from the cooling belt may be enlarged and streamlined to reduce back pressure and eliminate or reduce the buildup of coolant in the vicinity of the linear nozzle drainage slot. In some embodiments, the elongated nozzle assembly of the first nozzle arrangement has improved modularity and allows for each elongated dispensing slot to be individually set up. It further allows for the individual inserts of the nozzle assemblies to be removed, set up, or re-installed (e.g., during maintenance) as desired. In various embodiments, the cooling pad modules have improved modularity and allows for different nozzle layouts as desired. As a non-limiting example, the cooling pad assembly may have a first arrangement of cooling pad modules with a nozzle layout for a first alloy being cast, and a second arrangement of cooling pad modules with another nozzle layout for a second alloy being cast. In various embodiments, the multi-position nozzles may be provided in arrangements that may allow for improved control of heat transfer across the width of the casting cavity by selectively controlling the nozzles that are in the base position or the non-operating, depressed position (and/or in other positions over a range of heights). For example, in some cases, the nozzles may be set up to reduce heat flux in a local area to control the temperature of the metal product locally across the width of the cast product. Such control may provide a more consistent and homogeneous product profile, particularly where additional heating and/or cooling of a local area is not required to achieve a cross width temperature uniformity. In certain embodiments, the multi-position nozzles of the second nozzle arrangement may allow for the effective cooling cavity length to be shortened from a fixed machine maximum length.

Figure 2:
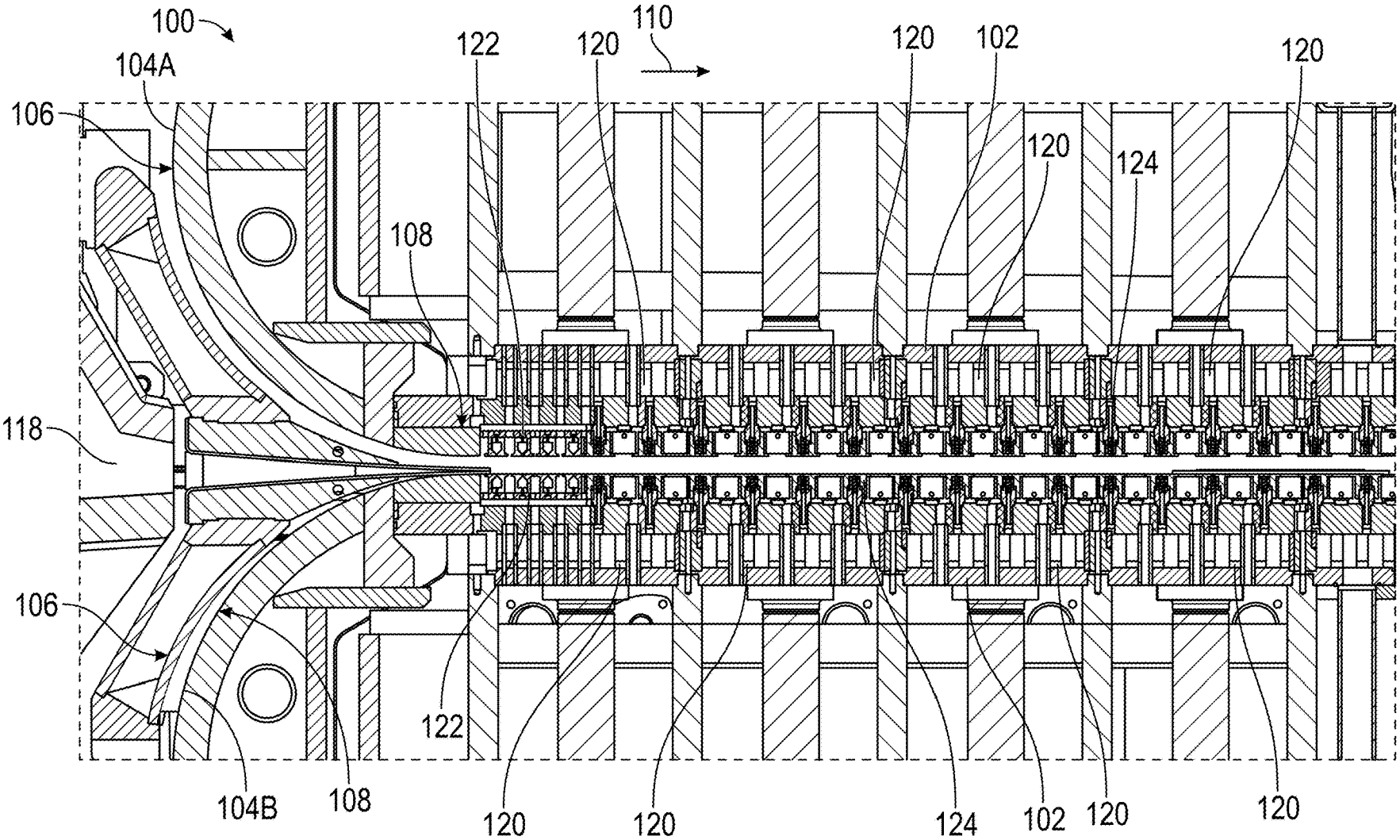
FIG. 2 is an enlarged view of the casting system of FIG. 1 taken from detail square 2 in FIG. 1.

FIGS. 1-30 illustrate a belt casting system 100 with cooling pad assemblies 102 according to various embodiments. The belt casting system 100 includes an upper endless belt 104A and a lower endless belt 104B. As shown in FIG. 2, each endless belt 104A-B includes a casting surface 106 and a rear surface 108, and the belts 104 are driven such that they rotate in a casting direction 110. As shown in FIG. 1, a casting cavity 112 is defined in a region where the casting surfaces 106 are positioned close together and has a casting cavity plane 119. The casting cavity 112 generally includes an inlet 114, where molten metal is introduced from a trough 118 or other suitable device, and an outlet 116, where the cast metal product exits. The belts 104A-B are respectively driven and supported by various suitable devices such that they rotate away from each other upon exiting outlet 116 of the casting cavity 112 and approach each other again at the inlet 114. During a casting process, the molten metal may be continuously fed to the casting cavity 112, and as the molten metal moves through the casting cavity 112 with the belts 104A-B, it is continuously cooled and solidified from the contact with the casting surfaces 106. A solid, cast product of indefinite length may be continuously withdrawn from the outlet 116. Upon exiting the outlet 116, the metal product may be further processed as desired.

Figure 3:
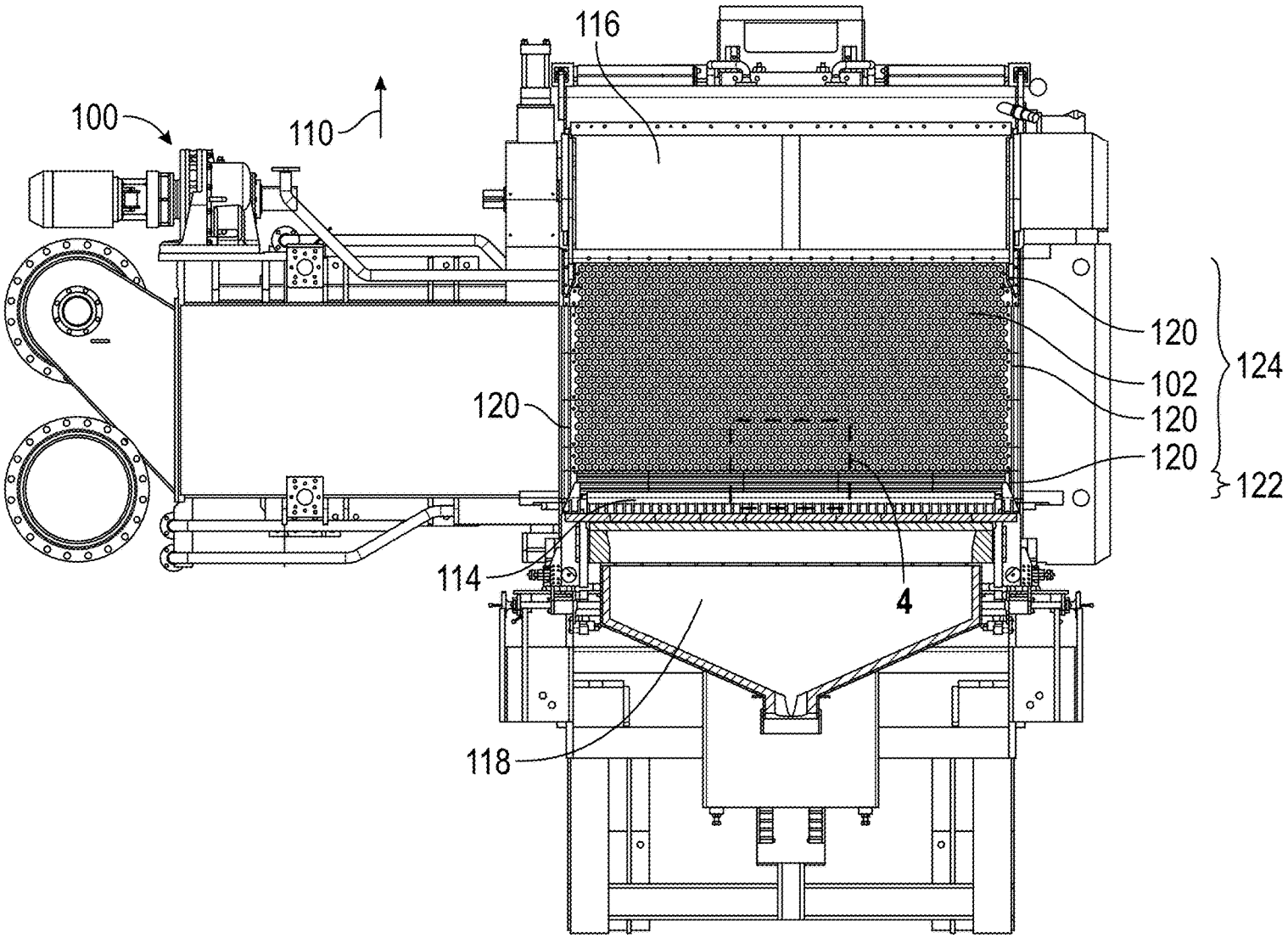
FIG. 3 is a top sectional view of the casting system of FIG. 1 along a casting axis extending through a casting mold of the casting system.
Figure 4:
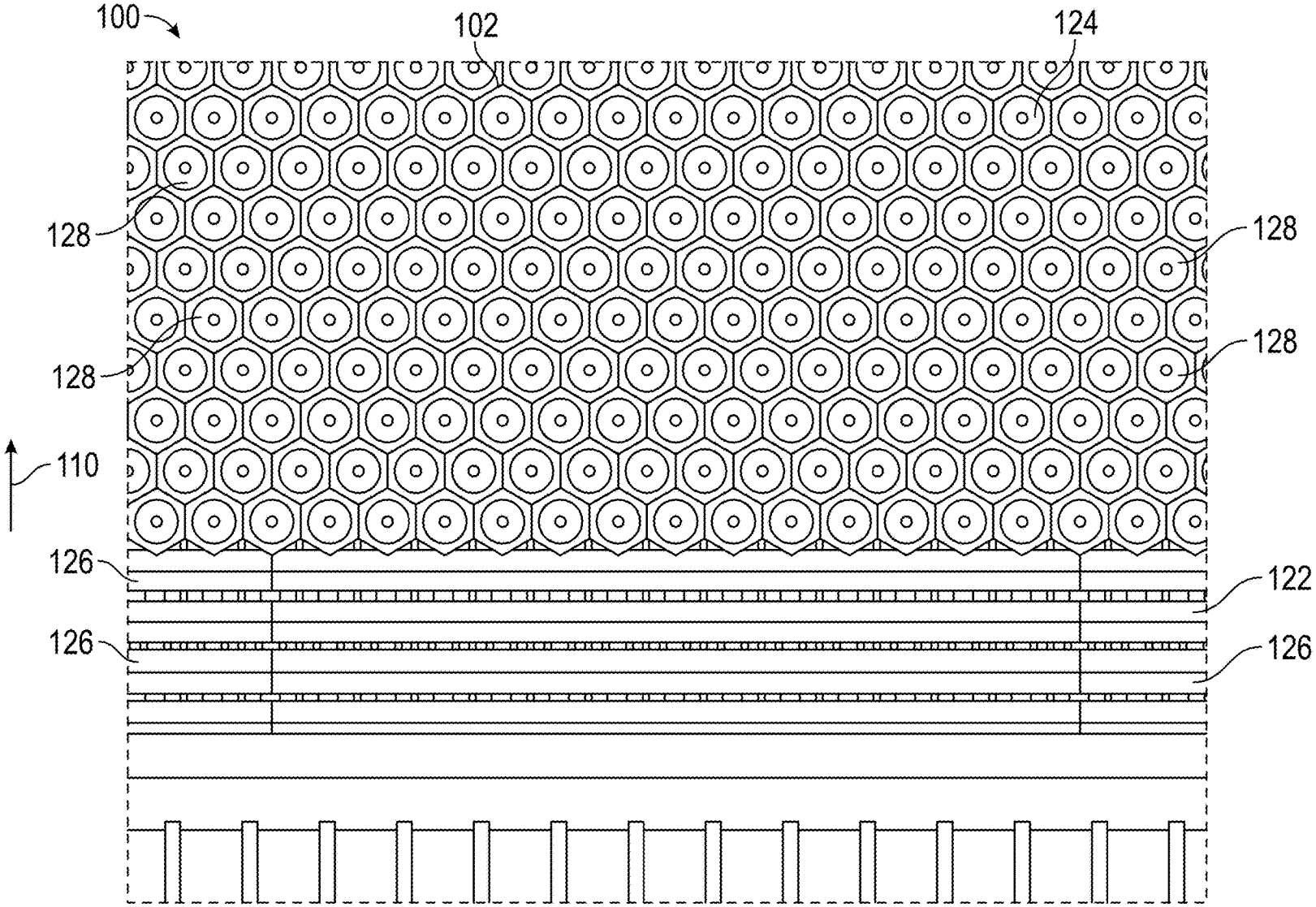
FIG. 4 is an enlarged view of the casting system taken from detail square 4 in FIG. 3.
Figure 5:
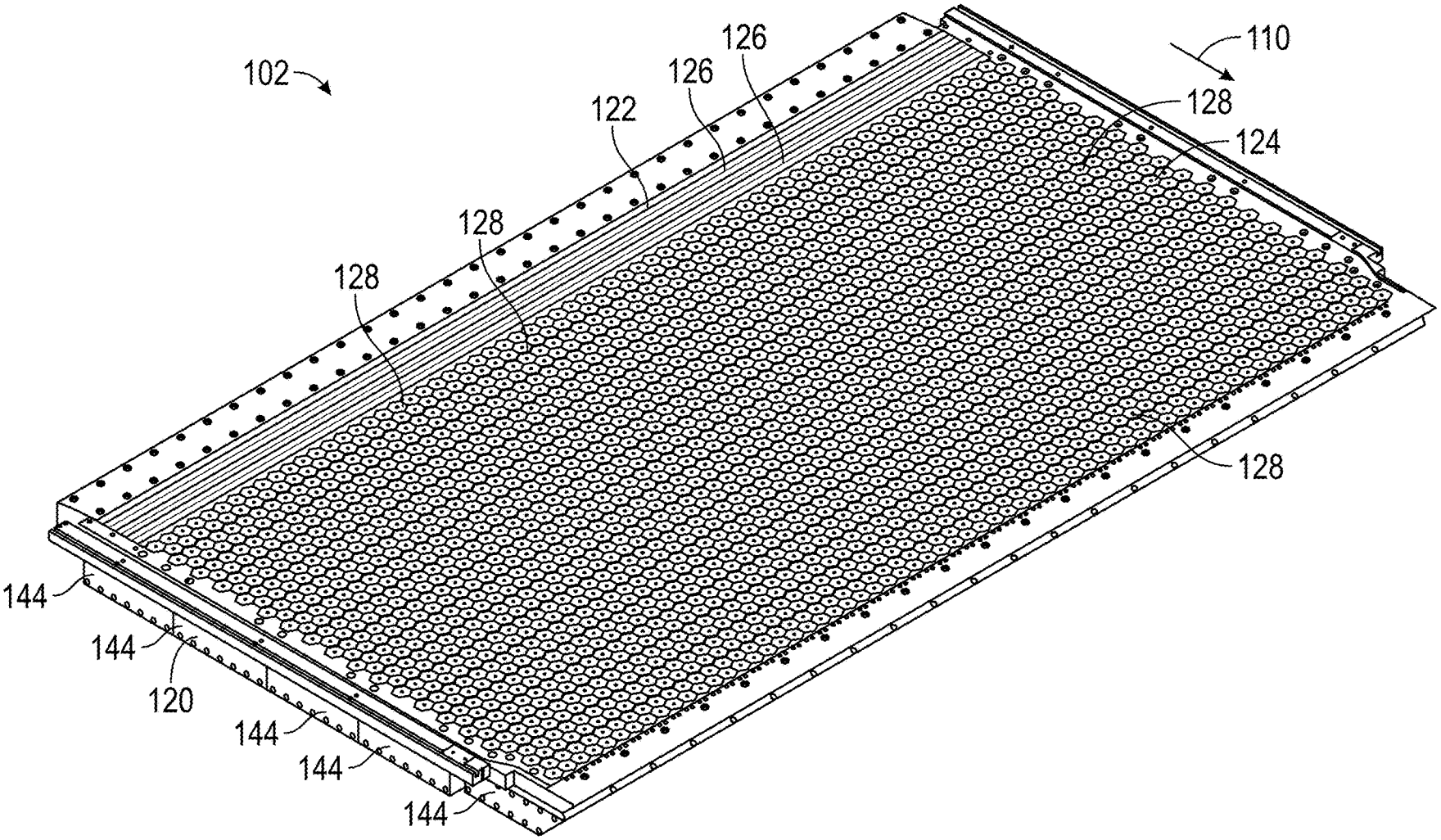
FIG. 5 is a perspective view of a cooling pad of the casting system of FIG. 1.
Figure 6:
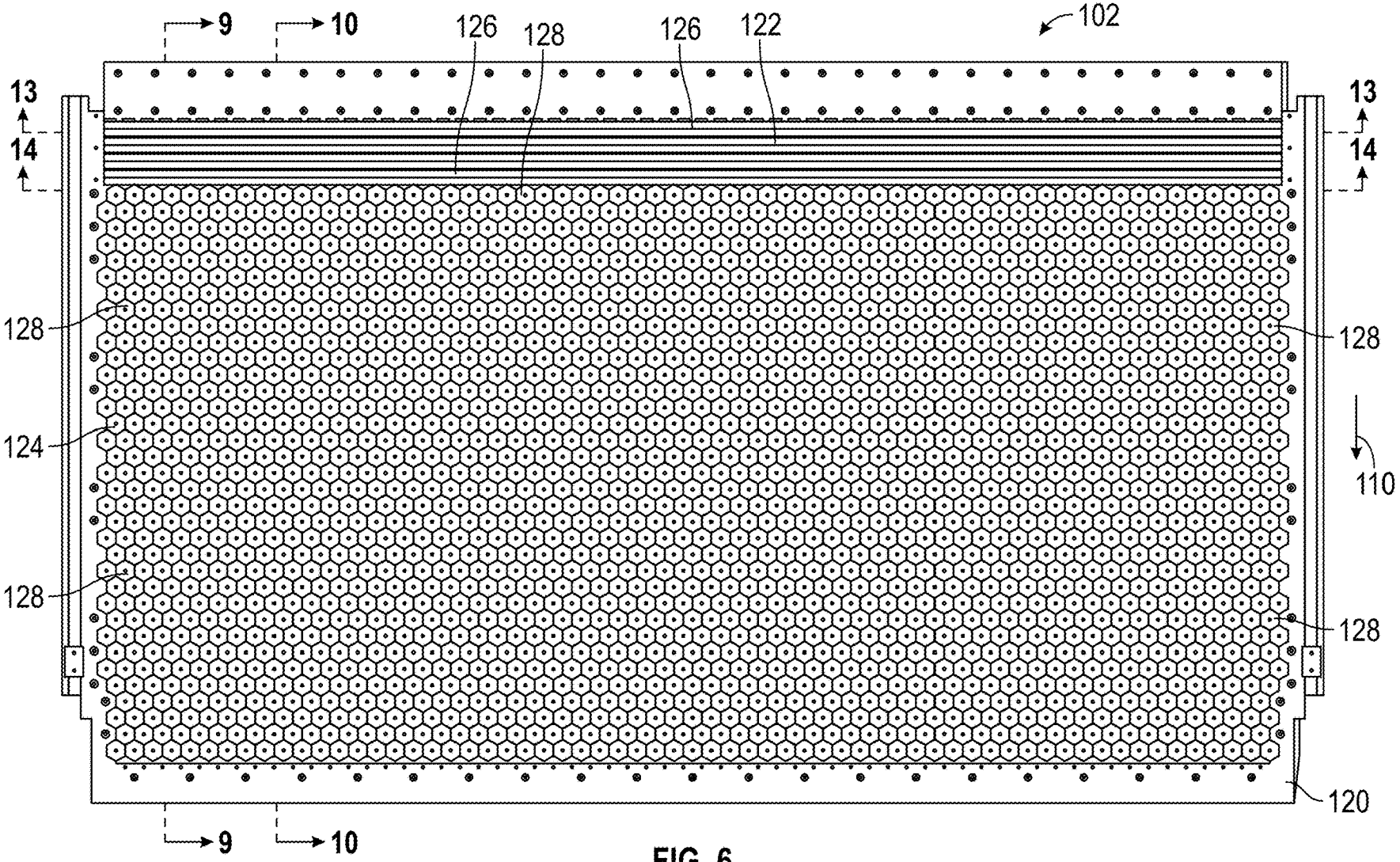
FIG. 6 is a top view of the cooling pad of FIG. 5.

As illustrated in FIG. 1, in various cases, a cooling pad assembly 102 may be provided for each of the endless belts 104A-B. FIG. 2 illustrates the cooling pad assembly 102 that is configured to cool the lower endless belt 104B during the casting process. As best illustrated in FIG. 3, the cooling pad assembly 102 includes a support assembly 120 with a first nozzle arrangement 122 and a second nozzle arrangement 124 that is downstream from the first nozzle arrangement 122. In various embodiments, and as will be discussed in greater detail below, the support assembly 120 may include one or more cooling pad modules (best illustrated in FIGS. 9-16). As best illustrated in FIG. 4, and as will be discussed in greater detail below, the first nozzle arrangement 122 includes one or more elongated nozzle assemblies 126, and the second nozzle arrangement 124 includes one or more multi-position nozzles 128. The cooling pad assembly 102 is arranged such that during the casting process, the internal surface 108 of the particular endless belt (e.g., the endless belt 104B) passes in close proximity past the first nozzle arrangement 122 and the second nozzle arrangement 124. As the endless belt passes over the first nozzle arrangement 122 and the second nozzle arrangement 124, the cooling pad assembly 102 may dispense coolant from the first nozzle arrangement 122 and the second nozzle arrangement 124 and against the rear surface 108 to cool the endless belt and withdraw heat from the metal in the casting cavity 112.

Cooling Pad Assembly

Figure 7:
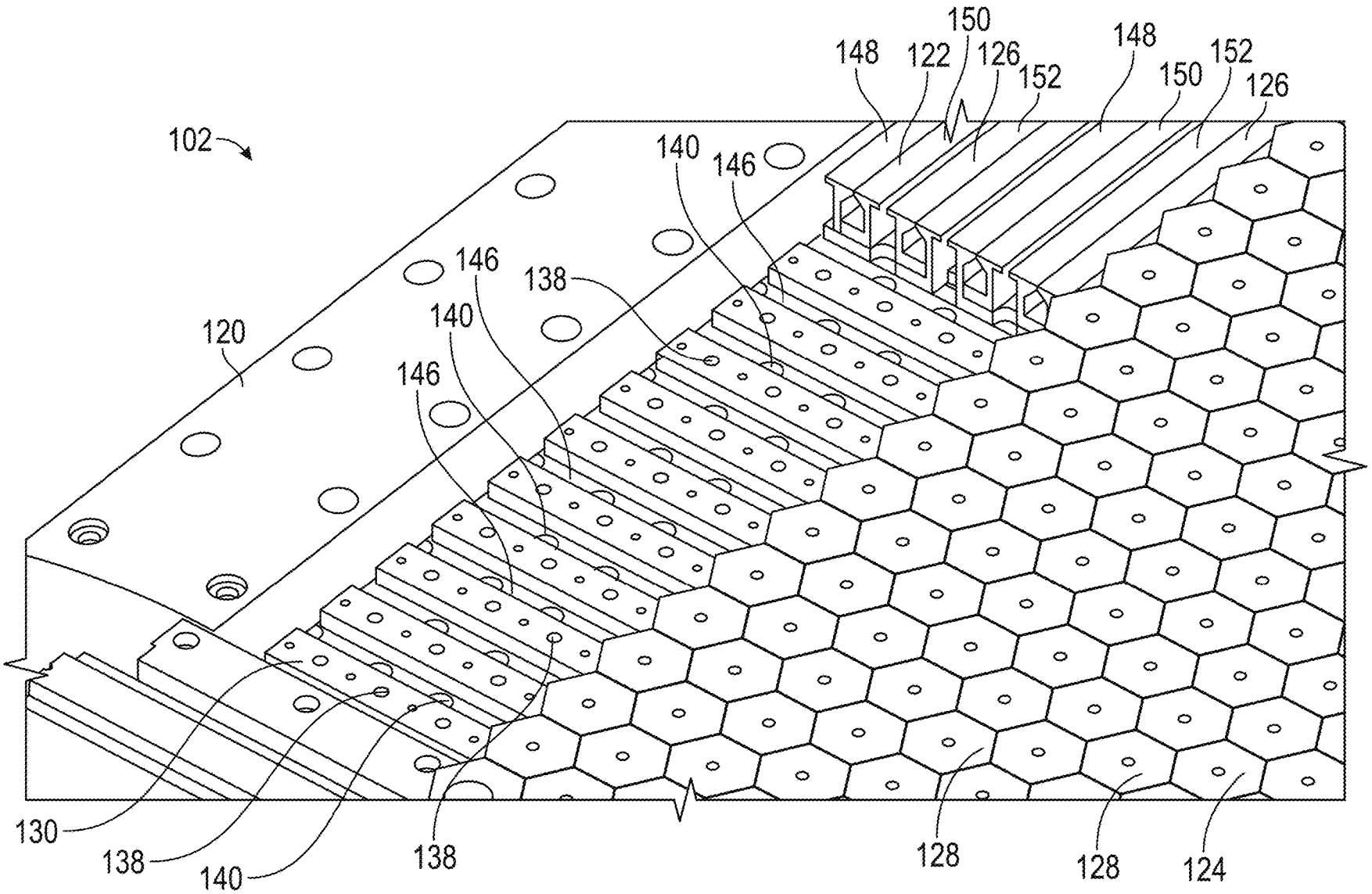
FIG. 7 is a perspective view of a portion of the cooling pad of FIG. 1 with some elongated nozzle assemblies removed such that a support assembly is visible.
Figure 8:
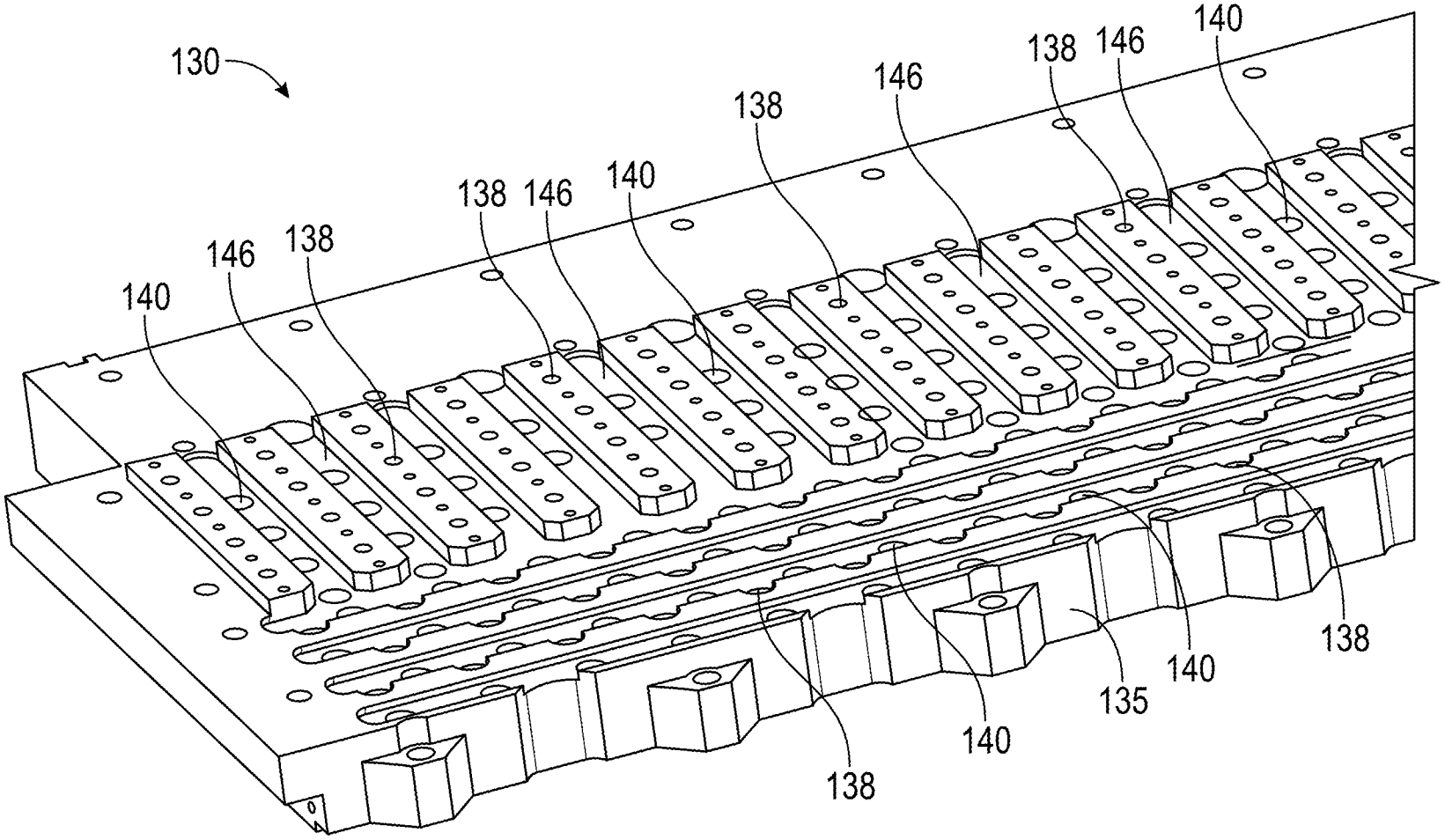
FIG. 8 is a perspective view of the support assembly of the cooling pad of FIG. 5.
Figure 9:
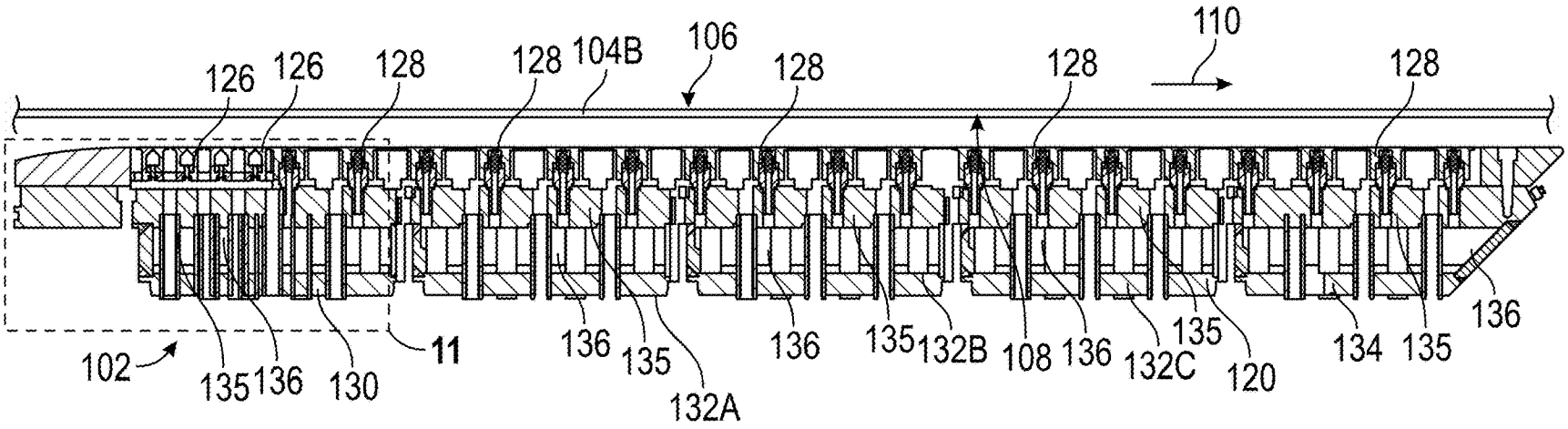
FIG. 9 is a sectional view of the cooling pad taken along line 9-9 in FIG. 6.
Figure 10:
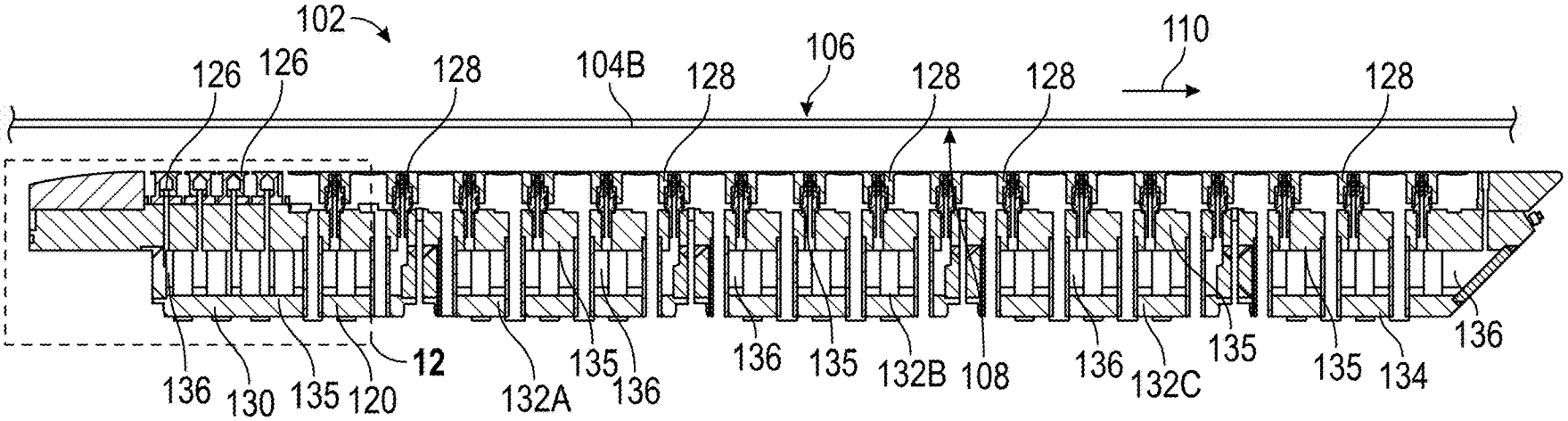
FIG. 10 is a sectional view of the cooling pad taken along line 10-10 in FIG. 6.
Figure 11:
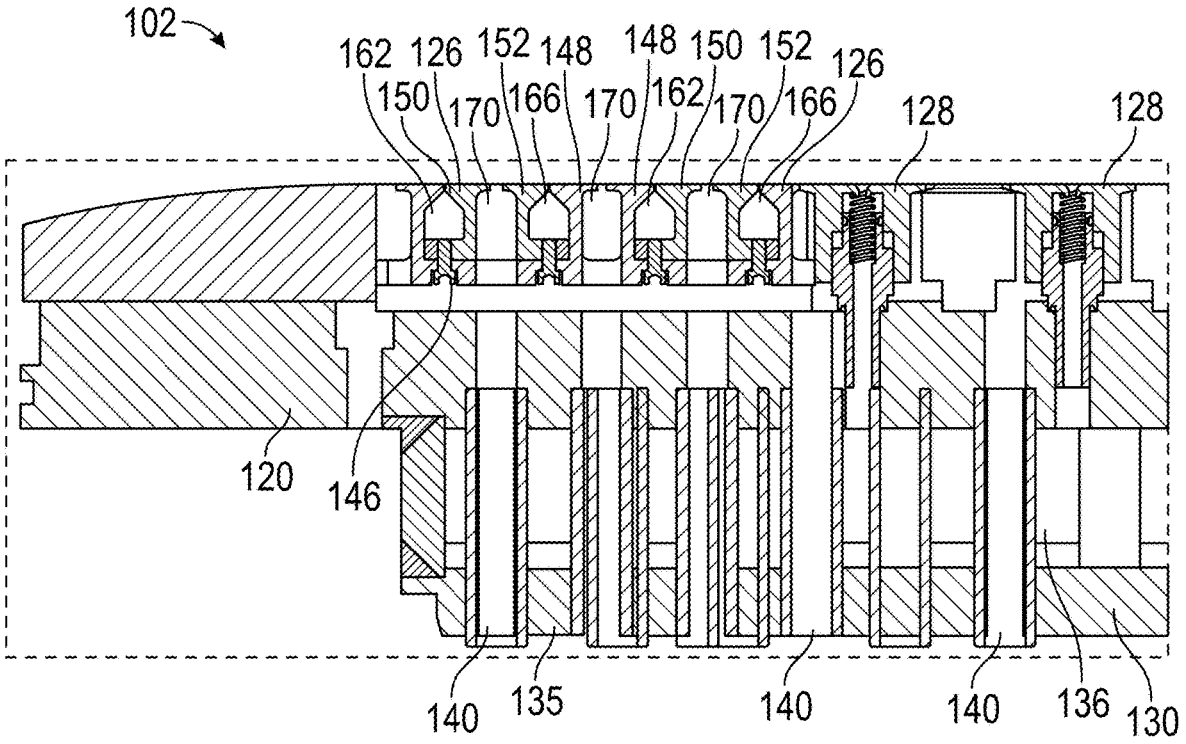
FIG. 11 is an enlarged view of the cooling pad taken from detail square 11 in FIG. 9.
Figure 12:
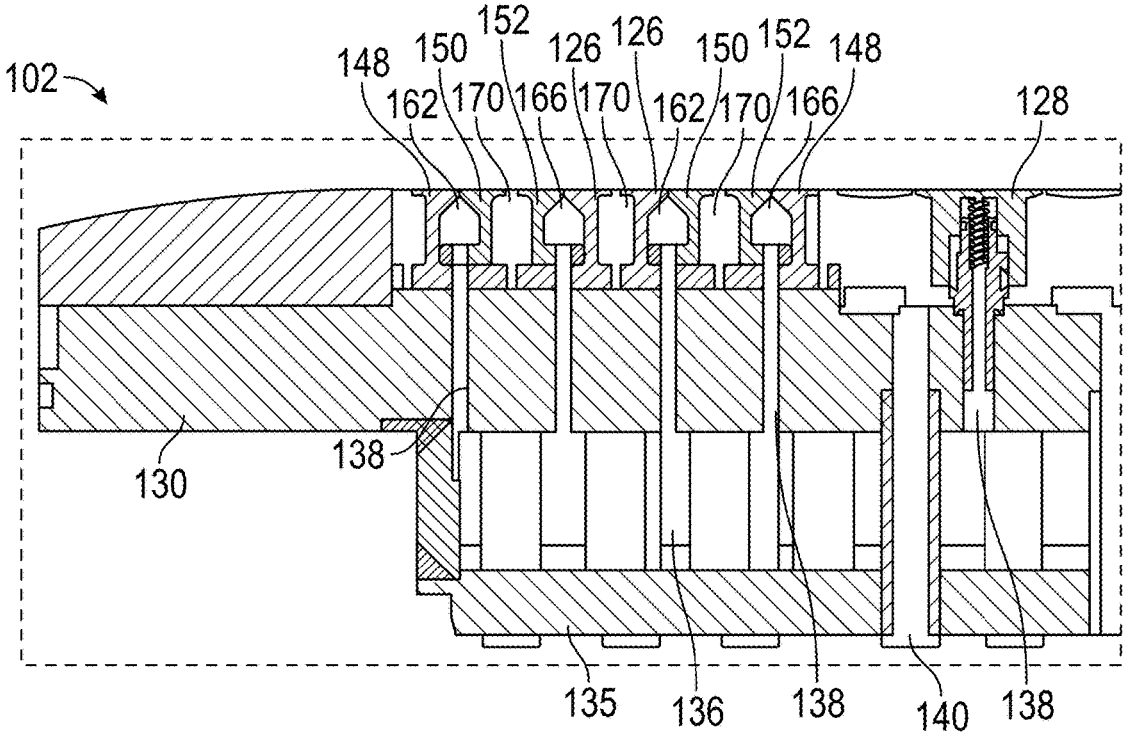
FIG. 12 is an enlarged view of the cooling pad taken from detail square 12 in FIG. 10.
Figure 13:
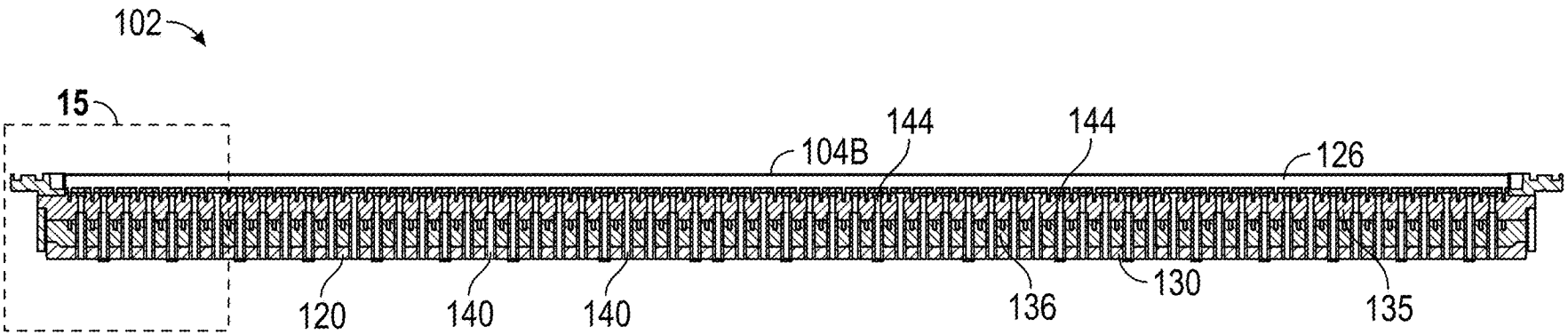
FIG. 13 is a sectional view of the cooling pad taken along line 13-13 in FIG. 6.
Figure 14:
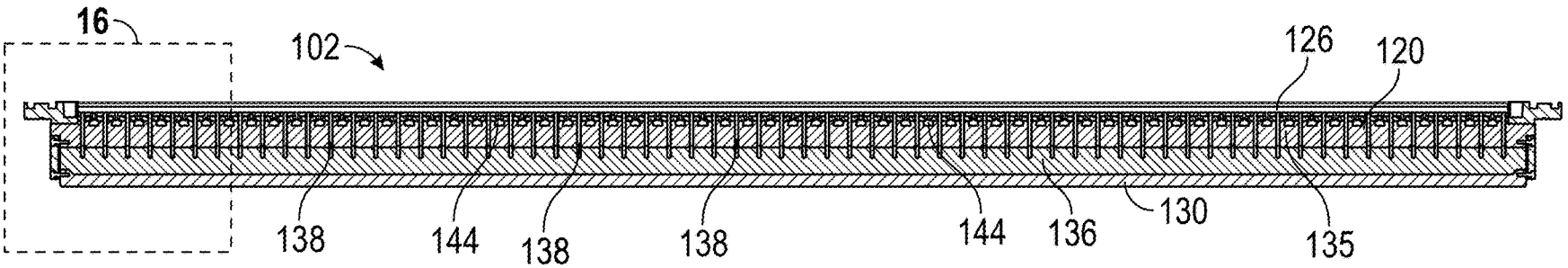
FIG. 14 is a sectional view of the cooling pad taken along line 14-14 in FIG. 6.

As best illustrated in FIGS. 5-16, the cooling pad assembly 102 supports both the first nozzle arrangement 122 and the second nozzle arrangement 124. As best illustrated in FIGS. 9 and 10, in various examples, the cooling pad assembly 102 includes support assembly 120, and the support assembly 120 may include a plurality of cooling pad modules (or segments) such that the longitudinal dimension of the cooling pad assembly 102 (i.e., the dimension extending in the casting direction 110) is adjustable as desired, or may be fixed to different lengths. In certain aspects, the cooling pad assembly 102 includes at least a front module 130 and a back module 134. The front module 130 may support elongated nozzle assemblies 126 of the first nozzle arrangement 122 and optionally supports at least some of the multi-position nozzles 128 of the second nozzle arrangement 124. The back module 134 may support at least some of the multi-position nozzles 128 of the second nozzle arrangement 124. In some examples, the cooling pad assembly 102 may include one or more intermediate modules 132 between the front module 130 and the back module 134. In the example illustrated, the cooling pad assembly 102 includes three intermediate modules 132A-C. In other examples, the number of intermediate modules 132 may be omitted, or fewer or more intermediate modules may be included. The modules 130, 132, 134 may be coupled through various suitable mechanisms as desired. In some cases, one or more modules 130, 132, 134 may be in fluid communication with each other, although they need not be in other examples. In certain embodiments, each module 130, 132, 134 may have a separate coolant feed such that coolant is individually supplied to each module 130, 132, 134 as desired.

Figure 15:
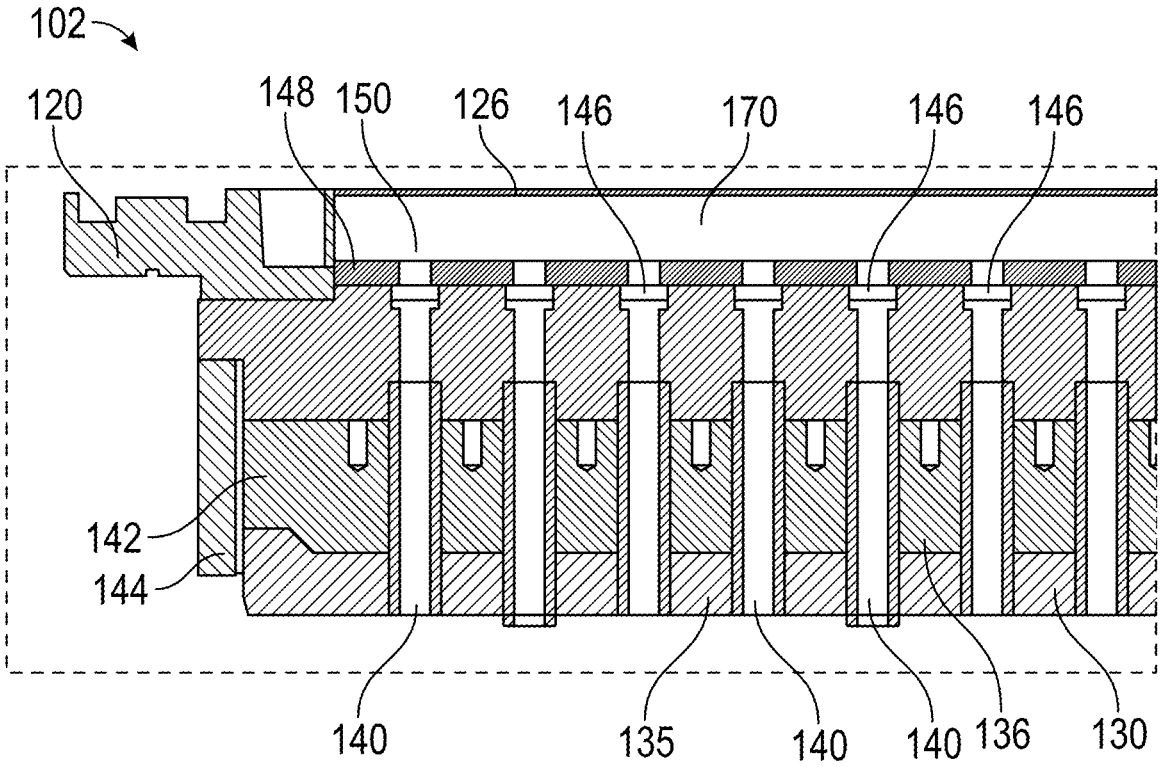
FIG. 15 is an enlarged view of the cooling pad taken from detail square 15 in FIG. 13.
Figure 16:
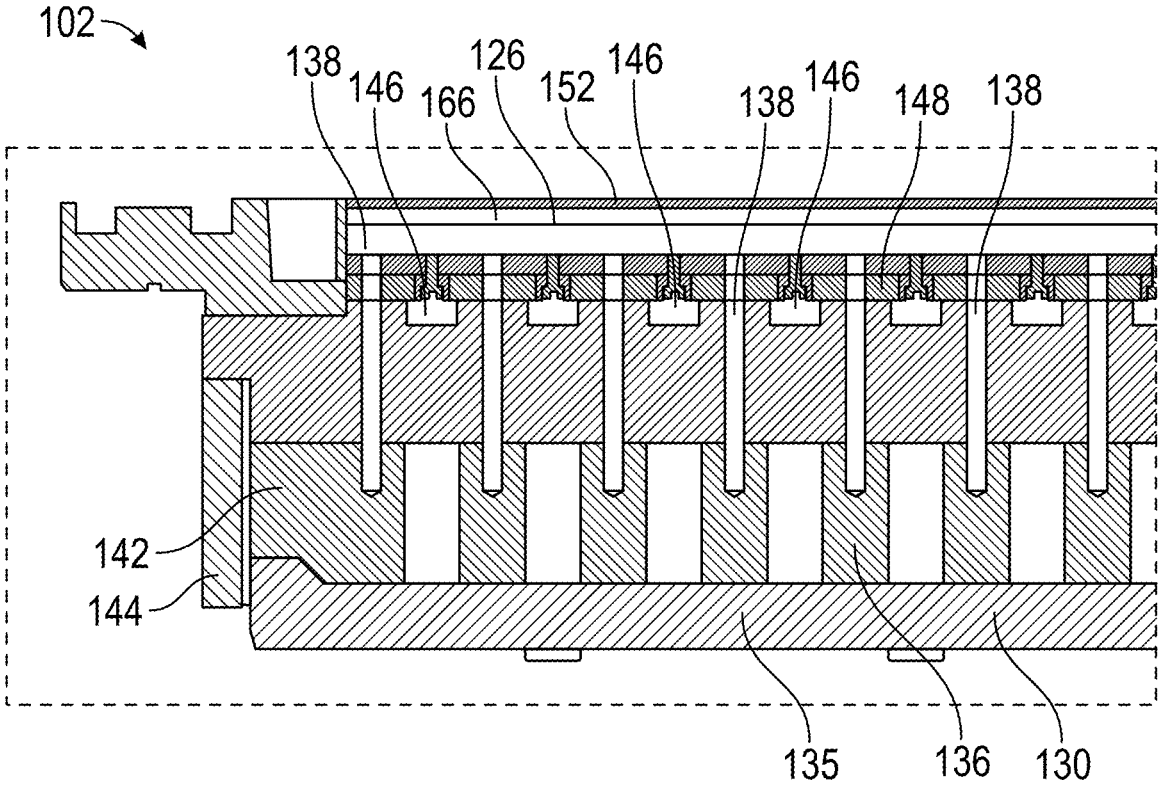
FIG. 16 is an enlarged view of the cooling pad taken from detail square 16 in FIG. 14.

The following description will be made with reference to the front module 130, although the description is equally applicable to the intermediate module 132A-C and the back module 134 unless noted otherwise. As shown in FIGS. 8-10, the front module 130 includes base 135 having a plenum chamber 136, a plurality of supply passages 138, and a plurality of drainage passages 140. The plenum chamber 136 functions as a distribution manifold to supply coolant to the nozzles of the module 130. In some embodiment, the plenum chamber 136 may provide a uniform supply of coolant to all supply passages, although in other embodiments, the plenum chamber 136 need not provide a uniform supply of coolant to all passages, and the amount of coolant to any particular nozzle may be varied or adjusted as desired. Optionally, and as best illustrated in FIGS. 15 and 16, the plenum chamber 136 includes a side port 142 (optionally at both ends of the plenum chamber 136), and a side cap 144 is removably attached to selectively enable or prevent access to the plenum chamber 136 through the side port(s) 142. In various aspects, these removable side caps 144 and the side ports 142 may facilitate maintenance of the cooling pad assembly 102 by providing easy access to the plenum chamber 136.

The supply passages 138 and the drainage passages 140 may each extend in a vertical direction. Each supply passage 138 is in fluid communication with the plenum chamber 136. As discussed in detail below, each supply passage 138 is also in fluid communication with at least one dispensing aperture of the first nozzle arrangement 122 or the second nozzle arrangement 124 such that the coolant can flow from the plenum chamber 136, through the supply passage(s) 138, and out the dispensing aperture to cool the endless belt. The drainage passages 140 may receive and transport coolant after it has been dispensed and withdrawn through a drainage aperture of the nozzle arrangement (e.g., through a drainage slot of the first nozzle arrangement 122 or between adjacent multi-position nozzles 128 of the second nozzle arrangement 124).

In some examples, each drainage passage 140 is laterally and longitudinally offset relative to an adjacent supply passage 138, although they need not be in other examples. In certain aspects, and as best illustrated in FIGS. 7 and 8, at least the portion of the front section 130 that supports the first nozzle arrangement 122 has drainage passages 140 that are laterally and longitudinally offset from adjacent supply passages 138. In various aspects, at least in the portion of the front section 130 that supports the first nozzle arrangement 122, a transverse dimension (e.g., a diameter) of a supply passage 138 is less than a transverse dimension of a drainage passage 140. In various examples, and as best illustrated in FIGS. 7 and 8, at least the portion of the front section 130 that supports the first nozzle arrangement 122 includes one or more drainage channels 146 extending in a longitudinal direction. In various aspects, the drainage channel(s) 146 may extend across at least a portion of the width of the first section 130. As best illustrated in FIGS. 7 and 8, a particular drainage channel 146 may intersect two or more drainage passages 140 such that at least two drainage passages 140 are in fluid communication with each other. In certain aspects, the drainage channel(s) 146 may improve the removal of coolant and may allow for the coolant to be removed even if a particular drainage passage 140 is blocked or otherwise has an issue.

First Nozzle Arrangement

As best illustrated in FIGS. 5-7 and 9-20, the first nozzle arrangement 122 includes one or more elongated nozzle assemblies 126. In various aspects, the first nozzle arrangement 122 is supported on the first module 130 of the cooling pad assembly 102 such that the first nozzle arrangement 122 is closer to the inlet 114 of the casting cavity 112 than the second nozzle arrangement 124, and the first nozzle arrangement 122 is the first nozzle arrangement to cool the endless belt 104 moving through the casting cavity 112.

In the example illustrated, the cooling pad assembly 102 includes two elongated nozzle assemblies 126 where one elongated nozzle assembly 126 is downstream from the other elongated nozzle assembly 126. Any number of elongated nozzle assemblies 126 may be utilized, including one nozzle assembly 126, three nozzle assemblies 126, four nozzle assemblies 126, etc.

Figure 20:
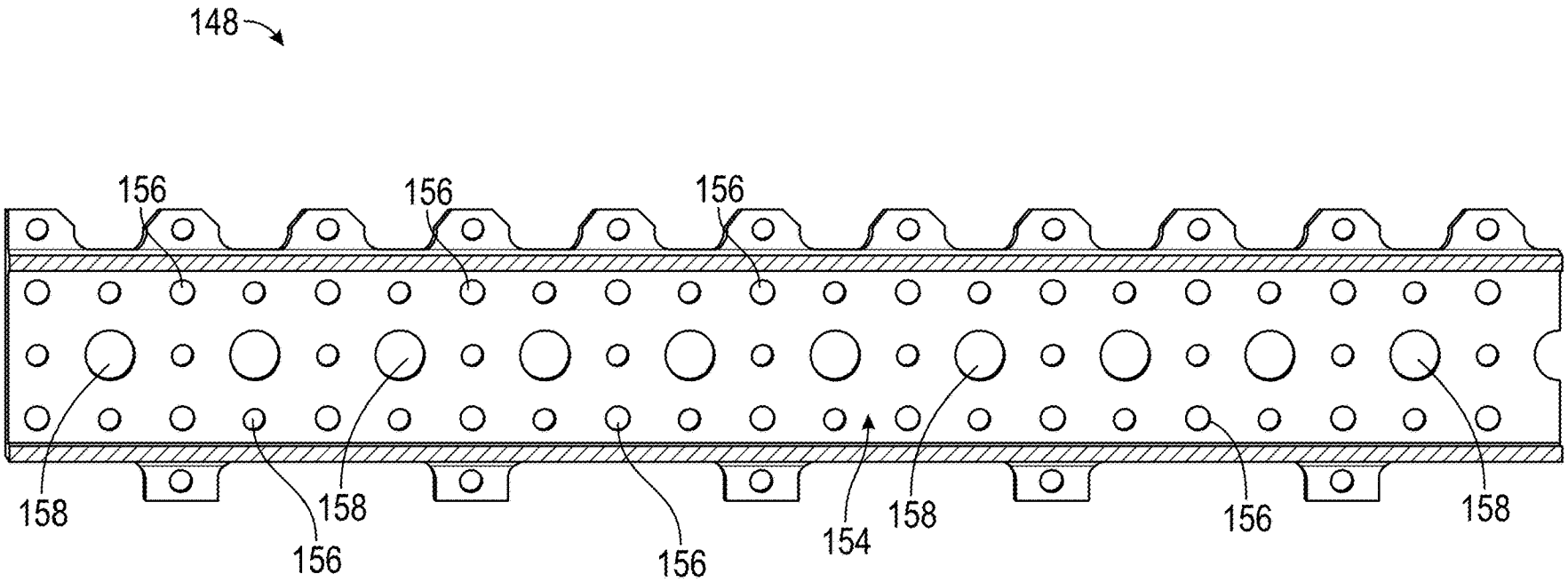
FIG. 20 is a sectional view of the base of the elongated nozzle assembly of FIG. 17 taken along line 20-20 in FIG. 19.
Figure 22:
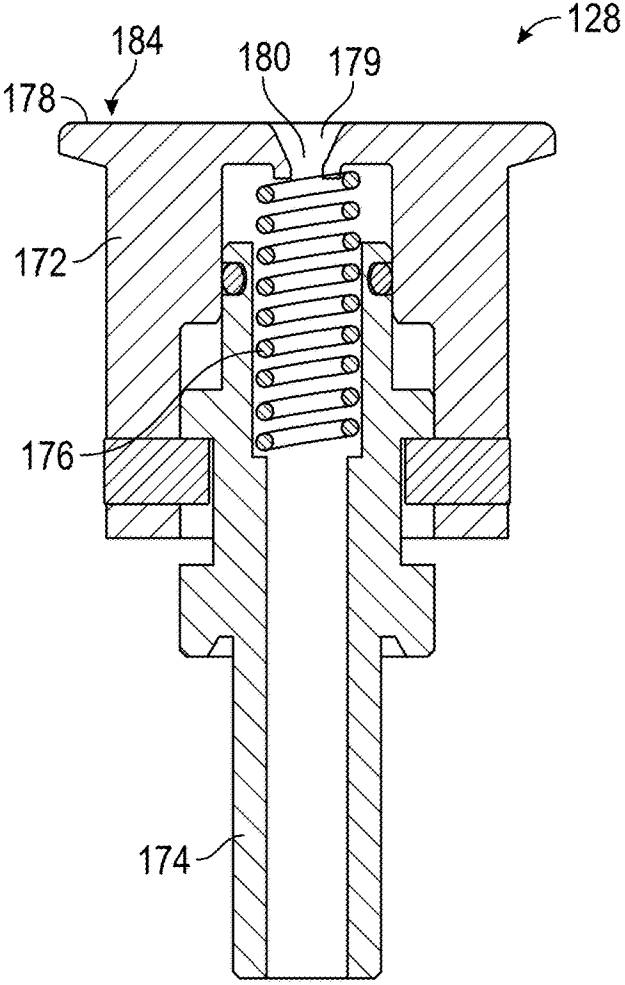
FIG. 22 is a sectional view of the nozzle of FIG. 21 taken along line 22-22 in FIG. 21.
Figure 21:
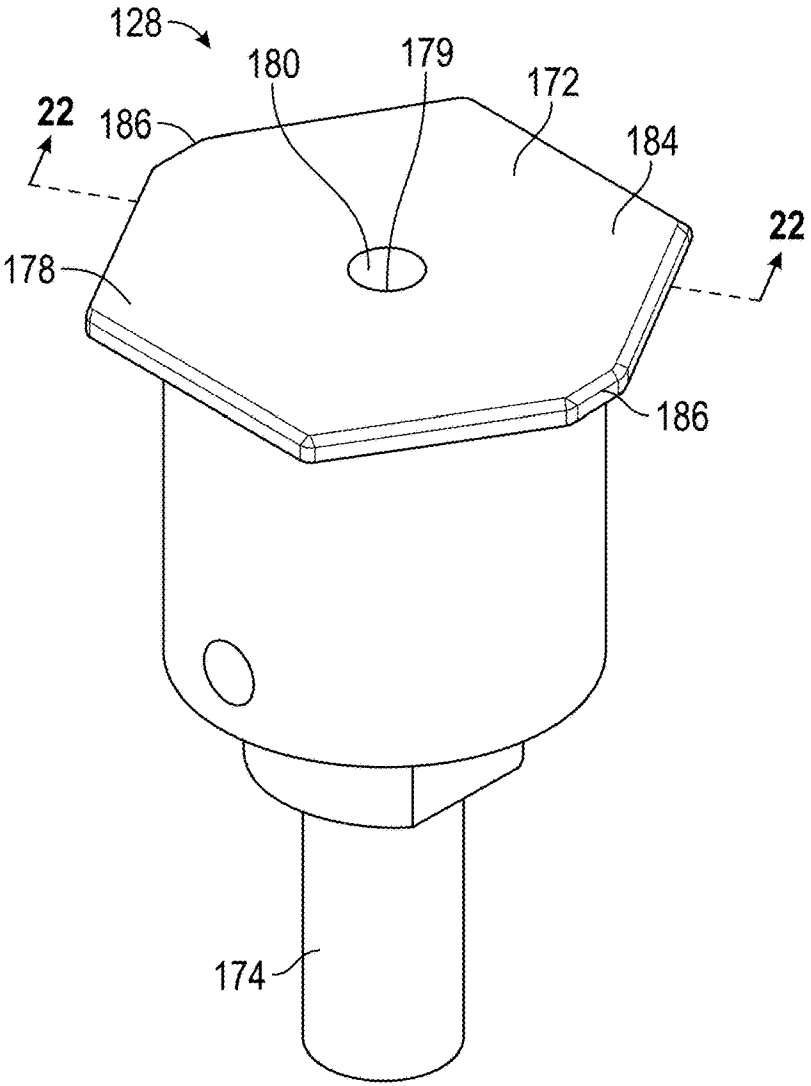
FIG. 21 is a perspective view of a multi-position nozzle of the cooling pad of FIG. 5.

As best illustrated in FIGS. 17-20, each elongated nozzle assembly 126 includes a base 148, a first insert 150, and a second insert 152. The base 148 defines a receiving area 154 and includes a plurality of dispensing apertures 156 and a plurality of drainage aperture 158. When the elongated nozzle assembly 126 is assembled on the first cooling pad module 130 of the cooling pad assembly 102 the base 148 may be connected to the base 135 via various suitable mechanisms or devices as desired. In various embodiments, when the elongated nozzle assembly 126 is assembled on the first cooling pad module 130, each dispensing aperture 156 is in fluid communication with a corresponding supply passage 138, and each drainage aperture 158 is in fluid communication with at least one corresponding drainage passage 140. Similar to the arrangement of drainage passages 140 and supply passages 138 on the support, on the base 148, each dispensing aperture 156 may be laterally and longitudinally offset from an adjacent drainage aperture 158. In various embodiments, and as best illustrated in FIG. 20, the drainage apertures 158 may be positioned laterally between a first subset of the dispensing apertures 156 and a second subset of the dispensing apertures 156, although they need not be in other examples. In certain aspects, a transverse dimension of a dispensing aperture 156 is less than a transverse dimension of a drainage aperture 158, although it need not be in other embodiments.

Figure 17:
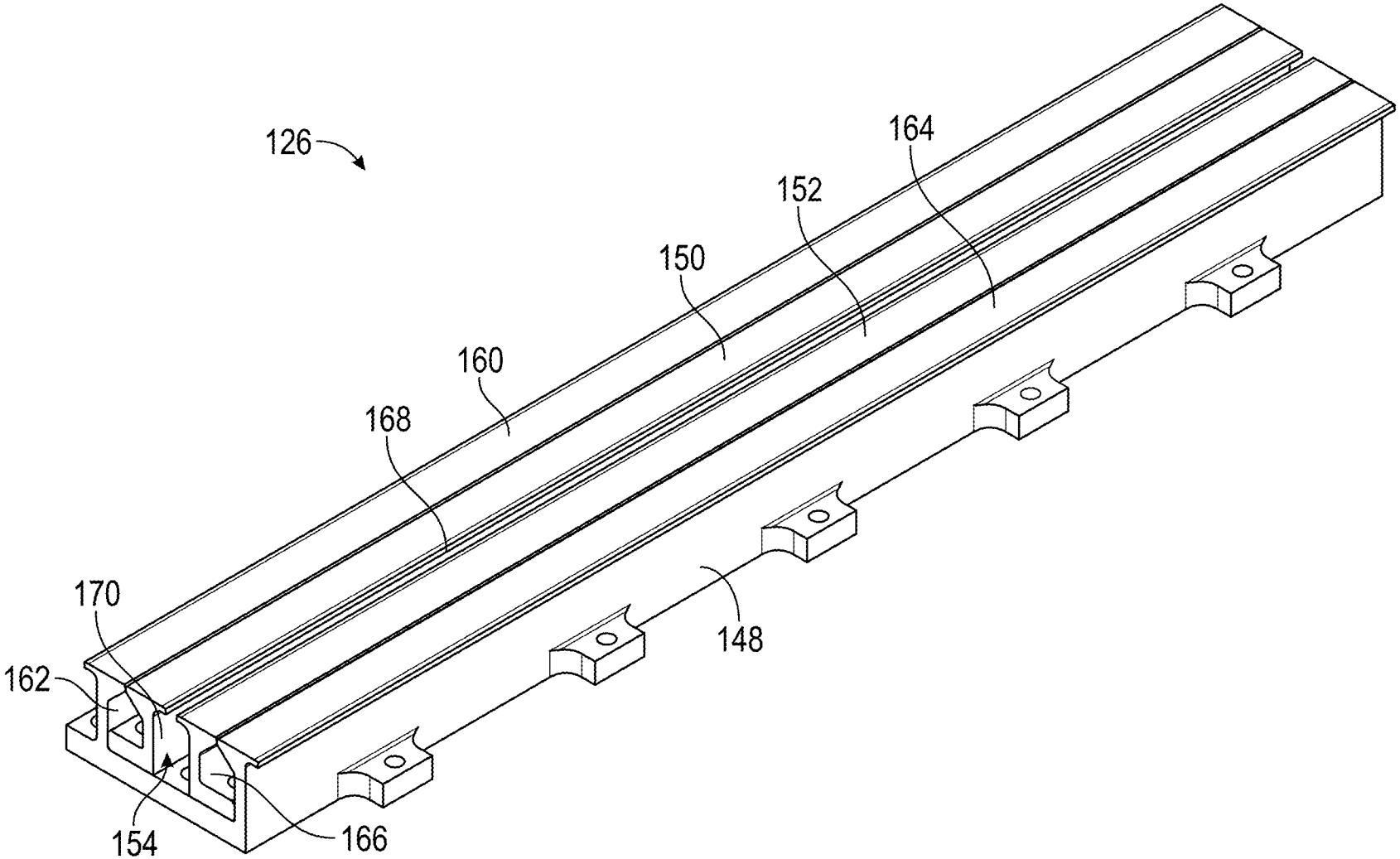
FIG. 17 is a perspective view of one of the elongated nozzle assemblies of the cooling pad of FIG. 5.
Figure 18:
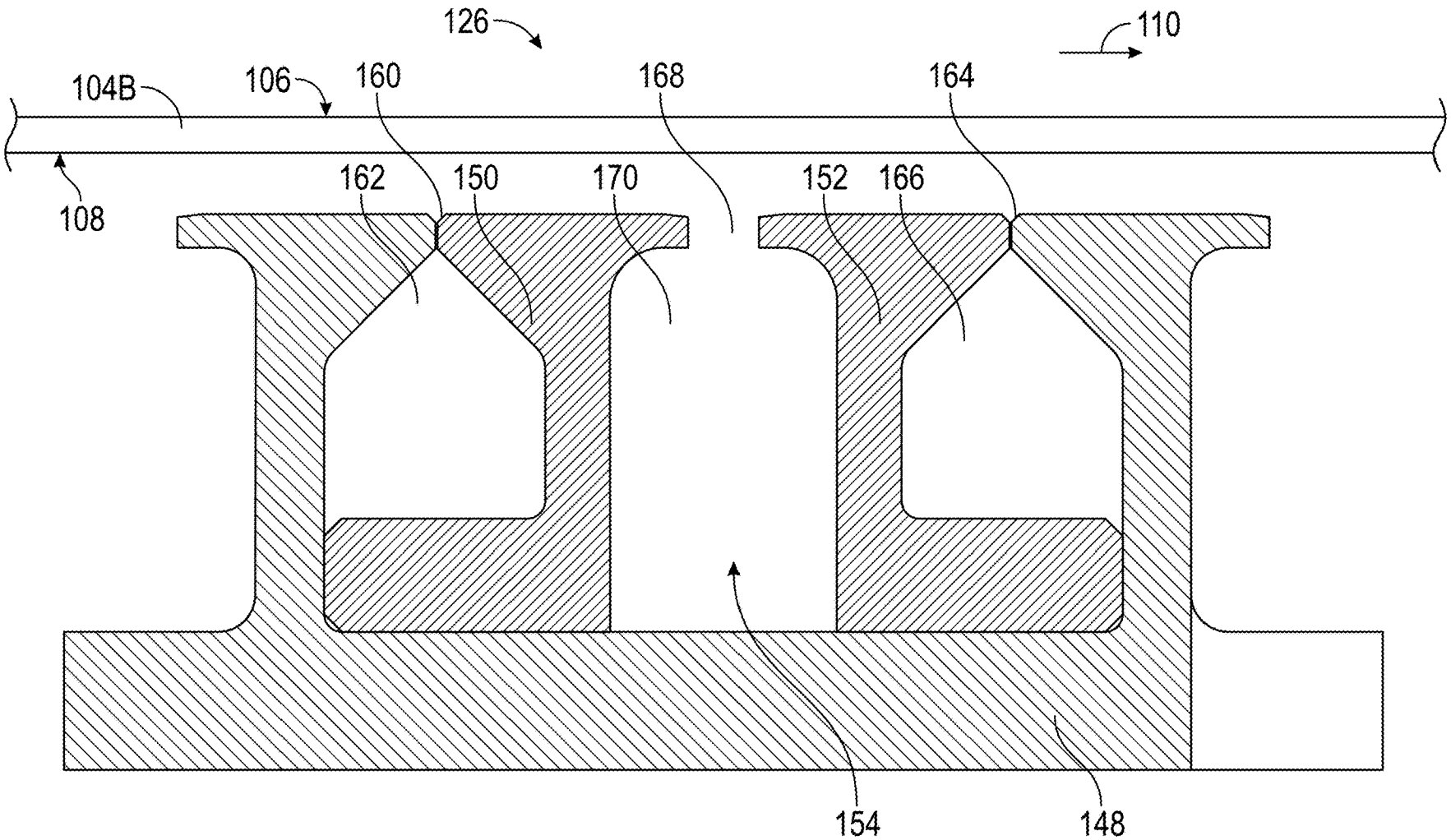
FIG. 18 is an end view of the elongated nozzle assembly of FIG. 17.
Figure 19:
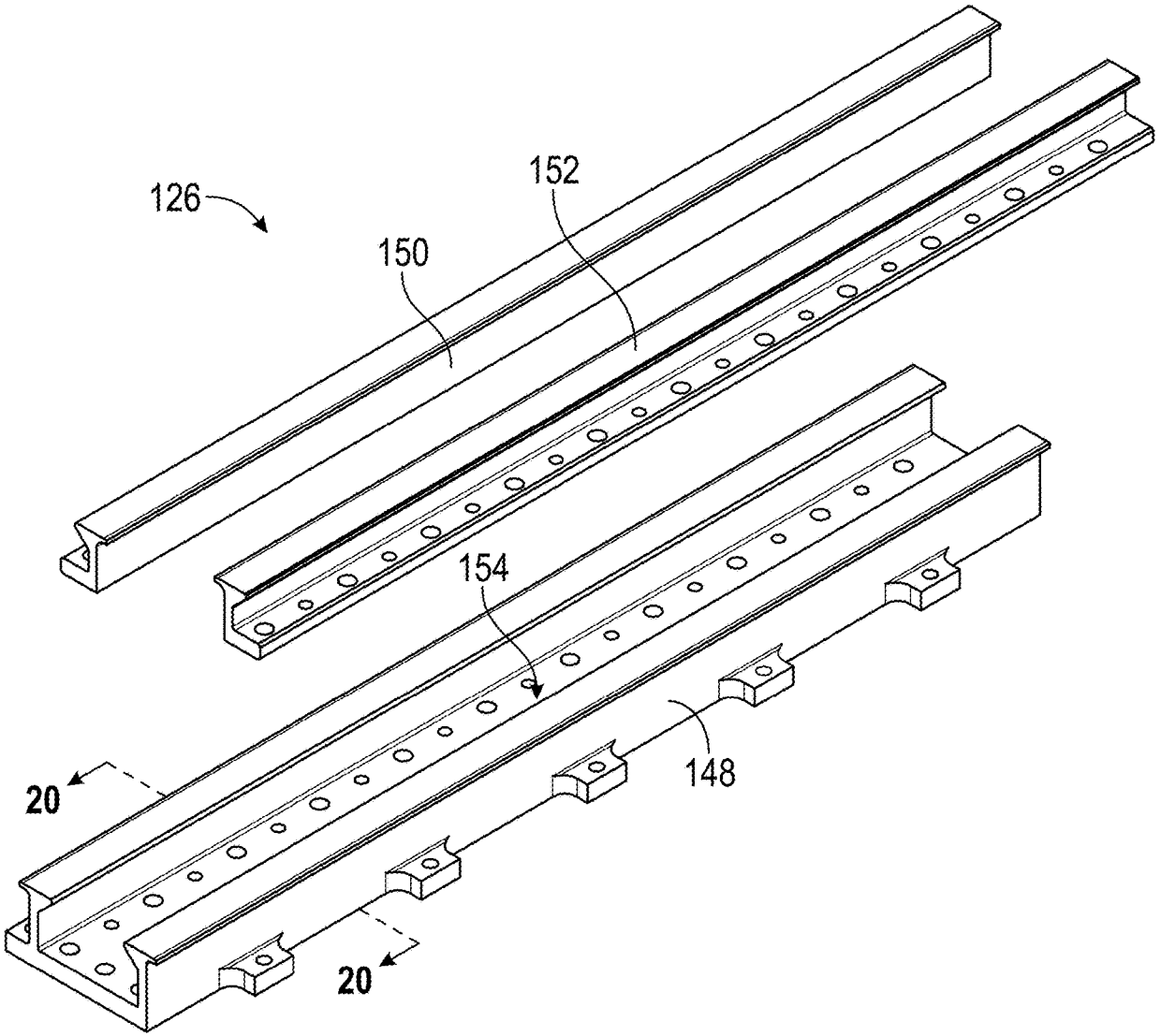
FIG. 19 is an exploded assembly view of the elongated nozzle assembly of FIG. 17.

The first insert 150 and the second insert 152 are each positionable within the receiving area 154. As shown in FIGS. 17-18, the first insert 150 and the base 148 together define a first elongated dispensing slot 160 and a first dispensing chamber 162, and the second insert 152 and the base 148 together define a second elongated dispensing slot 164 and a second dispensing chamber 166. In certain embodiments, the first elongated dispensing slot 160 and/or the second elongated dispensing slot 164 may extend in a direction that is perpendicular to the process pass line direction; however, in other embodiments, the first elongated dispensing slot 160 and/or the second elongated dispensing slot 164 need not extend in the direction that is perpendicular to the process pass line direction. As one non-limiting example, the first elongated dispensing slot 160 and/or the second elongated dispensing slot 164 may extend at an obtuse angle or an acute angle (or any other angle) relative to the pass line direction. As another non-limiting example, the first elongated dispensing slot 160 and/or the second elongated dispensing slot 164 may be arranged such that the first elongated dispensing slot 160 and/or the second elongated dispensing slot 164 forms a chevron pattern or other suitable pattern as desired. In this example; the elongated nozzle assembly 126 may include the elongated dispensing slots 160, 164 angled slightly and not perpendicular to the pass line direction. In another non-limiting example, the first elongated dispensing slot 160 and/or the second elongated dispensing slot 164 may be arranged as a set of parallel chevron segments made up from shorter linear nozzle segments, as a zig zag, and/or as a staggered style wave pattern in a direction perpendicular to the process pass line direction. Various other configurations of elongated nozzle assemblies may be utilized as desired.

In various examples, the first elongated dispensing slot 160 and the first dispensing chamber 162 are in fluid communication with the first subset of the dispensing apertures 156, and the second elongated dispensing slot 164 and the second dispensing chamber 166 are in fluid communication with the second subset of the dispensing apertures 156. As illustrated in FIG. 18, for example, the first insert 150 and the second insert 152 positioned within the receiving area 154 together define an elongated drainage slot 168 and a drainage chamber 170 that are in fluid communication with the drainage apertures 158. In embodiments with more than one elongated nozzle assembly 126, bases 148 of adjacent elongated nozzle assemblies 126 may also define a elongated drainage slot 168 and a drainage chamber 170 (see, e.g., FIG. 11).

The first insert 150 and the second insert 152 are independently adjustable or moveable relative to each other. In other words, the first insert 150 can move relative to the second insert 152 and/or without requiring movement of the second insert 152, and vice versa. In various embodiments, the first insert 150 and second insert 152 may be independently adjustable relative to each other such that a dimension of the first elongated dispensing slot 160 and the first dispensing chamber 162 can be independently set or adjusted relative to the second elongated dispensing slot 164 and the second dispensing chamber 166. Similarly, the elongated drainage slot 168 and the drainage chamber 170 may be adjusted or set by adjusting the first insert 150, the second insert 152, or both the first insert 150 and the second insert 152. The independent control of the dispensing slots and chambers of the elongated nozzle assembly 126 may allow for improved control of the coolant dispensed by the cooling pad 102 to provide a desired cooling profile. The independently adjustable first insert 150 and second insert 152 may also allow for maintenance and/or replacement of one of the inserts without requiring the removal and/or replacement of the other insert.

When the elongated nozzle assembly 126 of the first nozzle arrangement 122 is assembled on the first module 130 of the cooling pad assembly 102, the first elongated dispensing slot 160, the second elongated dispensing slot 164, and the elongated drainage slot 168 are elongated in the transverse direction of the casting direction 110, or are elongated across the width of the cooling pad assembly 102. A single elongated nozzle assembly 126 may define the slots across the width of the cooling pad assembly 102 or a plurality of nozzle assemblies 126 may be arranged across the width of the cooling pad assembly 102 to form continuous slots. Each slot may extend fully or partially across the width of the particular endless belt 104 and face the internal surface 108. In various examples, the first nozzle arrangement 122 with the elongated nozzle assembly (or assemblies) 126 is positioned immediately adjacent to the inlet 114 of the casting cavity 112 so that the coolant introduced through the elongated dispensing slots 160, 164 is the first coolant to contact the rear surface 108 of the endless belt 104 as the endless belt 104 moves through the casting cavity 112 in the casting direction 110. In various examples, the elongated dispensing slots 160, 164 may each supply a uniform flow of the coolant to provide substantially uniform cooling to the endless belt 104 across the width of the endless belt 104. As previously mentioned, the dimension of the elongated dispensing slots 160, 164 may each be individually controlled, and the control of the slots may control the uniformity and amount of cooling that is provided by the coolant. After being dispensed through the elongated dispensing slots 160, 164, the coolant may drain through the elongated drainage slot 168.

Second Nozzle Arrangement

As best illustrated in FIGS. 5-7, 9-12, and 21-30, the second nozzle arrangement 124 includes a plurality of multi-position nozzles 128. In various aspects, the multi-position nozzles 128 may be supported on one or more of the first module 130, the intermediate modules 132A-C, and/or the back module 134 of the cooling pad assembly 102 as desired. As best illustrated in FIGS. 5-8, the second nozzle arrangement 124 is supported downstream from the first nozzle arrangement 122 such that the second nozzle arrangement 124 supplies coolant on the endless belt 104 after the first nozzle arrangement 122. Compared to the first nozzle arrangement 122, which provides substantially uniform cooling across a width of the cooling pad assembly 102 (and thus across the width of the endless belt 104 passing across the cooling pad arrangement 102), the second nozzle arrangement 124 may be controlled to provide various cooling profiles across the width of the endless belt 104, including both uniform cooling and non-uniform cooling.

Referring to FIGS. 21-30, each multi-position nozzle 128 includes a cap 172 and a stem 174. In various examples, a resilient member 176 may be provided on the stem 174 that is biased against the cap 172 and that locks the cap 172 in a particular position relative to the stem 174 (discussed below). The cap 172 includes a dispensing end 178 having a dispensing opening 180. Optionally, a round tapered dish 179 may be provided at a center (or other suitable location) of the dispensing end 178. Coolant may flow through the multi-position nozzle 128 and out the dispensing orifice 180 during the casting process. In various examples, the dispensing end 178 includes a plurality of edges 182 that form a hexagonal perimeter such that a surface 184 of the dispensing end 178 has a flat, hexagonal shape. In other embodiments, the dispensing end 178 may have various other shapes as desired.

As best illustrated in FIGS. 27-30, the stem 174 may include a pair of grooved guideways 161. Each grooved guideway 161 includes a first end 163, a second end 165, and a vertical groove 167. The cap 172 may include a pair of pins 169 that are rotationally and axially movable along the grooved guideways 161. In various embodiments, the vertical grooves 167 may provide a path for installing and removing the cap 172 from the stem 174. In various embodiments, the first end 163 and the second end 165 may be vertically offset above a bottom of the grooved guideway 161 such that the caps 172 may be locked with a particular end (e.g., the cap must be depressed to disengage the cap from a particular end). In certain embodiments, on grooved guideway 161, a height of the first end 163 may be vertically offset from a height of the second end 165. In certain embodiments, and as discussed in detail below, the pins 169 of the cap 172 engaged with the first ends 163 of the grooved guideways 161 may position the cap 172 in a base position, and the pins 169 of the cap 172 engaged with the second ends 165 of the grooved guideways 161 may position the cap 172 in the offset position. In some embodiments, the when the cap 172 is rotated such that the pins 169 engage the first end 163, the cap 172 is spring loaded into the base position. Rotating the cap 172 such that the pins 169 engage the second end 165 may place the cap in the depressed, non-operating position. In certain embodiments, the cap 172 may be actuated over a range of heights that may include two or more positions. In such embodiments, the range of heights may be between the two positions shown in the figures, may be a range of heights that is broader than those illustrated, and/or may at least partially overlap the heights illustrated.

In some embodiments, the cap 172 may include a position indicator 186. Any number of position indicators 186 may be utilized, and in the embodiment illustrated, the cap 172 has two position indicators 186. The position indicator 186 may be various suitable visual indicators including, but not limited to, a particular color, pattern, edge profile, edge shape, or other suitable indicator as desired. In the embodiment illustrated, the position indicators 186 include corners at the intersection of two adjacent edges 182 that are clipped or rounded. In certain embodiments, the position indicators 186 are aligned with the pins 169 such that a position or orientation of the position indicators 186 indicates the orientation of the pins 169. As discussed in detail below, the position indicator 186 may give a visual indication of a position of the cap 172 when assembled on the stem 174. As a non-limiting example, and as discussed in detail below, the position indicator 186 may give a visual indication of the working position of the cap 172 on the stem 174 based on its orientation or arrangement of the position indicator 186 relative to the casting direction 110.

Figure 24:
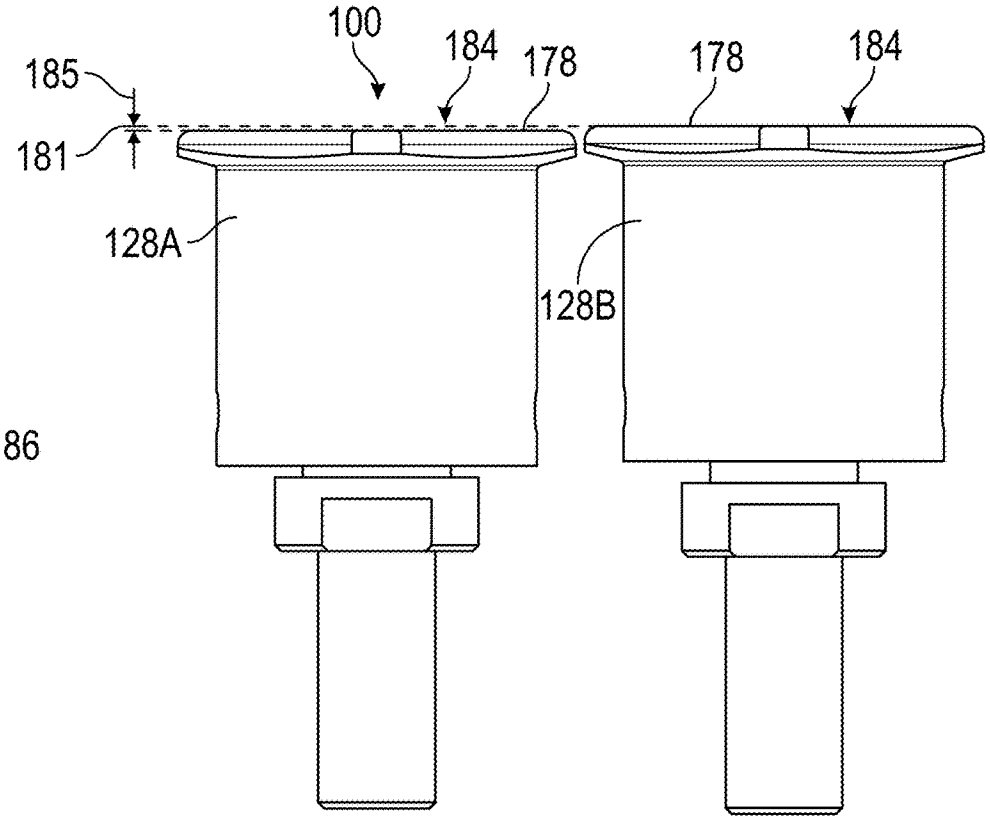
FIG. 24 is a side view of a nozzle arrangement of three of the nozzles of FIG. 21 with one nozzle in a base position and another nozzle in an offset position according to embodiments.
Figure 23:
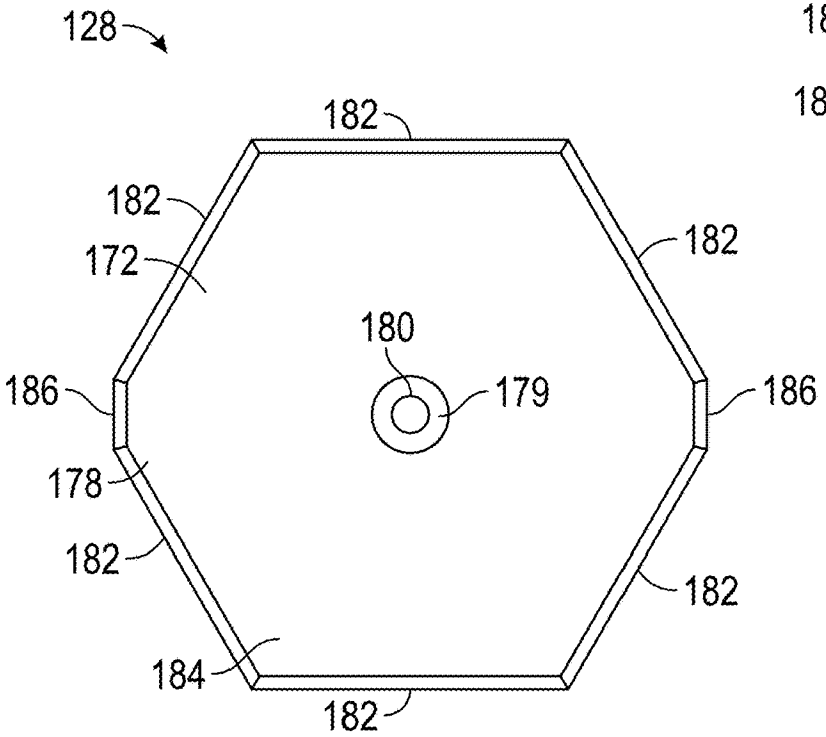
FIG. 23 is a top view of the nozzle of FIG. 21.

Referring to FIG. 24, for example, the cap 172 is rotatably and axially movable along a stem 174 such that a multi-position nozzle 128 may be in a base position (represented by multi-position nozzle 128B in FIG. 24) or an offset position (represented by multi-position nozzle 128A in FIG. 24). In various examples, in the offset position, the cap 172 is depressed, and the dispensing end 178 is offset by a distance 185 from a plane 181 defined by the dispensing end 178 in the base position and in a direction away from the cavity plane 119 (and as such away from the endless belt 104). In certain embodiments, the distance 185 is from about 0.1 mm to about 2.0 mm. In one non-limiting example, the distance 185 is 1.0 mm.

In various embodiments, the cap 172 may be assembled with the stem 174 by engaging the pins 169 with the vertical grooves 167 of the grooved guideways 161. Once the cap 172 is fully depressed to the bottom of this pair of vertical grooves 176, the cap 172 it can be rotated in either direction such that the pins 169 engage the first ends 163 or the second ends 165 of the grooved guideways 161 such that the cap 172 is one of two positions. When the cap 172 is engaged with the first ends 163, the cap 172 may be in the base position. In some cases, in this orientation, the position indicators 186 (which are aligned with the pins 169) may be oriented in the pass line direction, which indicates that the surface 184 of the cap 172 is co-planar with the nozzle plane as defined by the linear nozzle surface. When the cap 172 is rotated in the opposite direction such that the pins 169 engage the second ends 165, the cap 172 may be in the offset position. In this orientation, the position indicator 186 may be offset and/or otherwise not aligned with the pass line direction, which indicates that the cap 172 is in the depressed, non-operating position and is farther away from the internal surface of the endless casting belt 104. This may provide a quick visual check on the status of the orientation and setup of a particular nozzle 128.

In certain embodiments, a multi-position nozzle 128 is movable from the base position to the offset position by depressing the cap 172 to unlock the cap 172 such that the pins 169 are no longer engaged with the first ends 163, and rotating the cap 172 by a predetermined angle and in a predetermined direction relative to the stem 174. In various examples, rotating the cap 172 also includes axially moving the cap 172 along the stem 174. In various examples, the predetermined angle is from greater than 0° to 90°. In one non-limiting example, the predetermined angle is 60°. As one non-limiting example, to move the multi-position nozzle 128 from the base position to the offset position, the cap 172 may be rotated 60° and in a clockwise direction relative to the stem 174, and to move the multi-position nozzle 128 from the offset position to the base position, the cap 172 may be rotated 60° and in a counter-clockwise direction relative to the stem.

Depending on the position of the multi-position nozzle 128, the multi-position nozzle 128 may cause the endless belt 104 to have different levels of contact with the metal in the casting cavity 112 and thus different levels of heat transfer between the metal and the endless belt 104. For example, the multi-position nozzle 128 in the base position (or the position closest to the cavity plane 119 and closest to the endless belt 104) may provide the most contact between the endless belt 104 and the metal (and thus the most heat transfer). Conversely, the multi-position nozzle 128 in the offset position (or the position farthest from the cavity plane 119 and farthest from the endless belt 104) may allow for the belt 104 to lose intimate contact with the metal (i.e., the belt 104 may be drawn away from the metal) and the heat transfer rate is diminished in the region with this nozzle.

Figure 25:
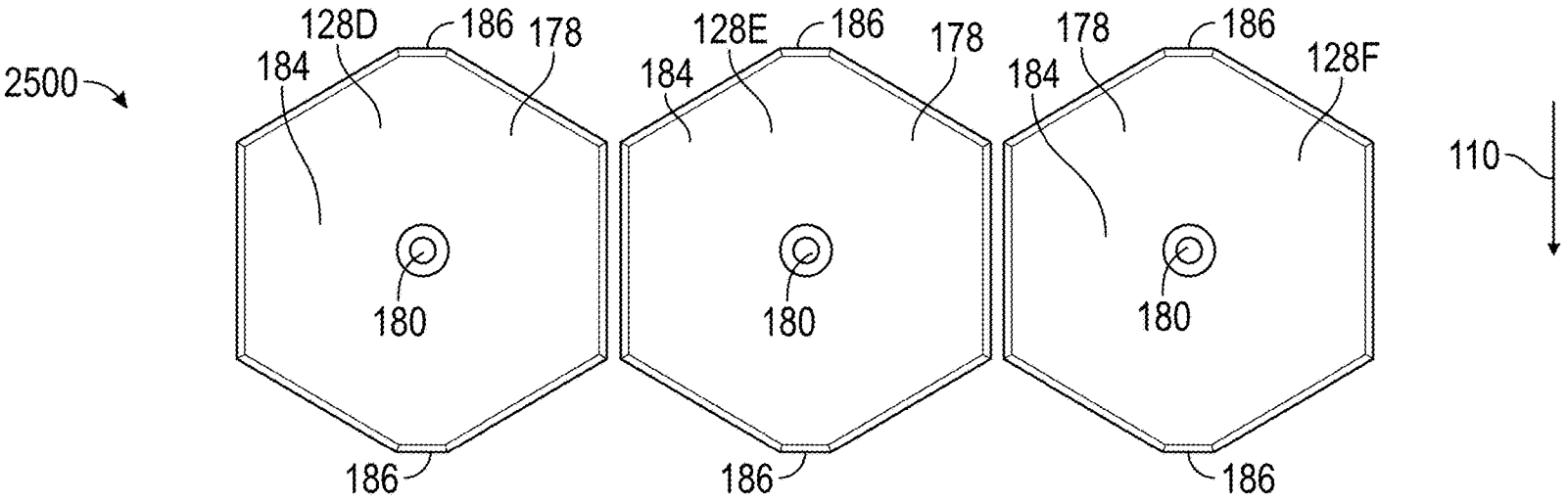
FIG. 25 is a top view of an example of a nozzle arrangement according to embodiments.
Figure 26:
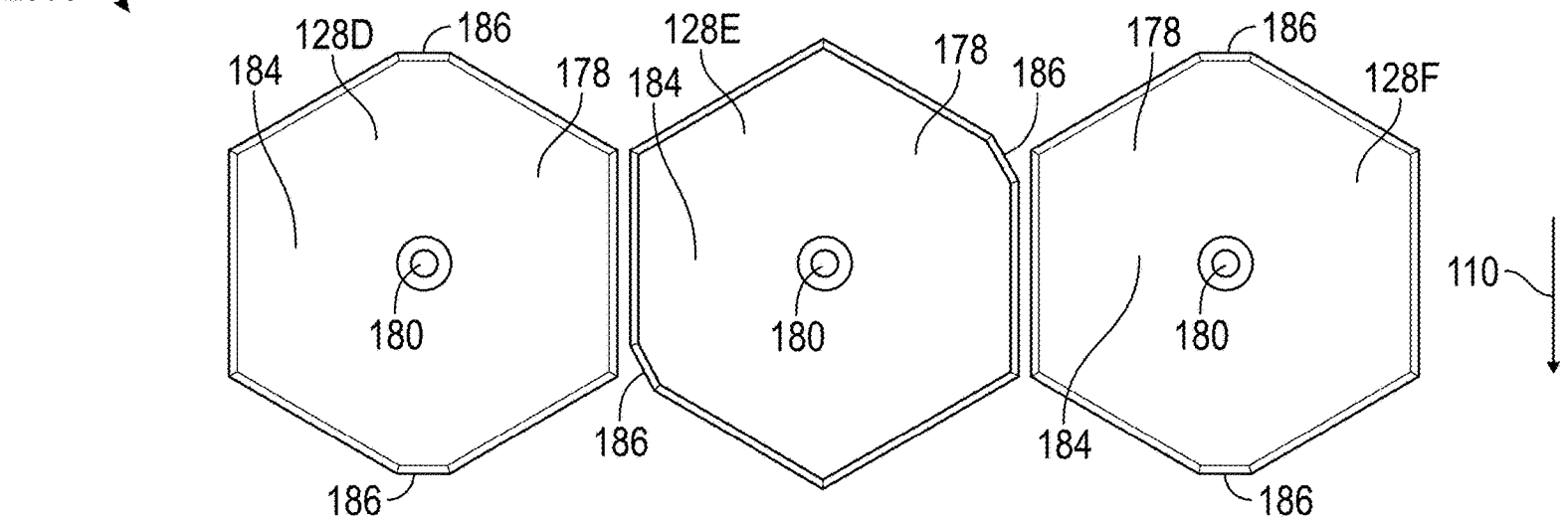
FIG. 26 is a top view of another example of a nozzle arrangement according to embodiments.
Figure 27:
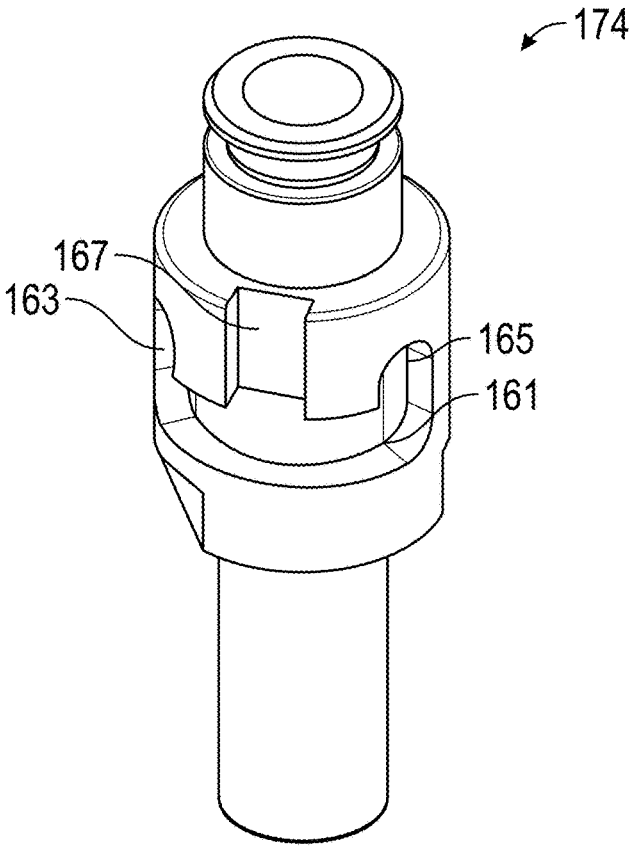
FIG. 27 is a perspective view of a stem of the multi-position nozzle of FIG. 21.
Figure 28:
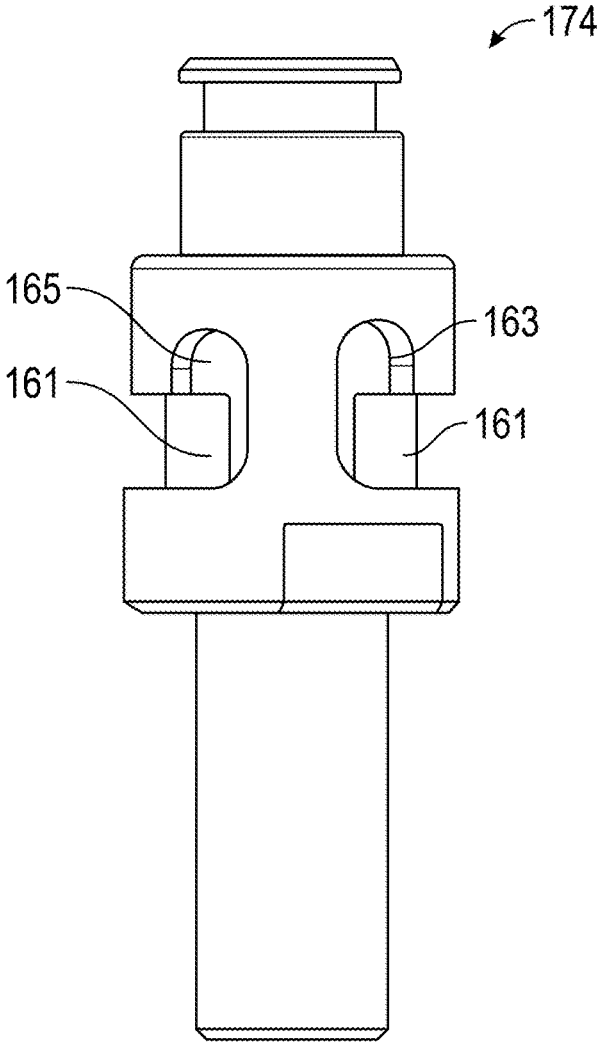
FIG. 28 is another perspective view of the stem of FIG. 27.
Figure 30:
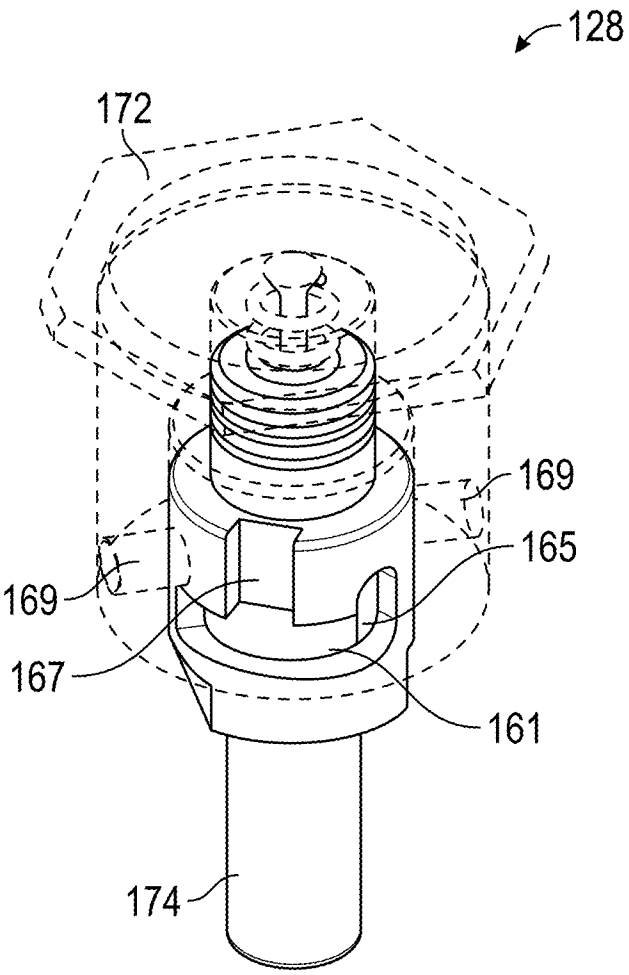
FIG. 30 is another perspective view of the multi-position nozzle of FIG. 21.
Figure 29:
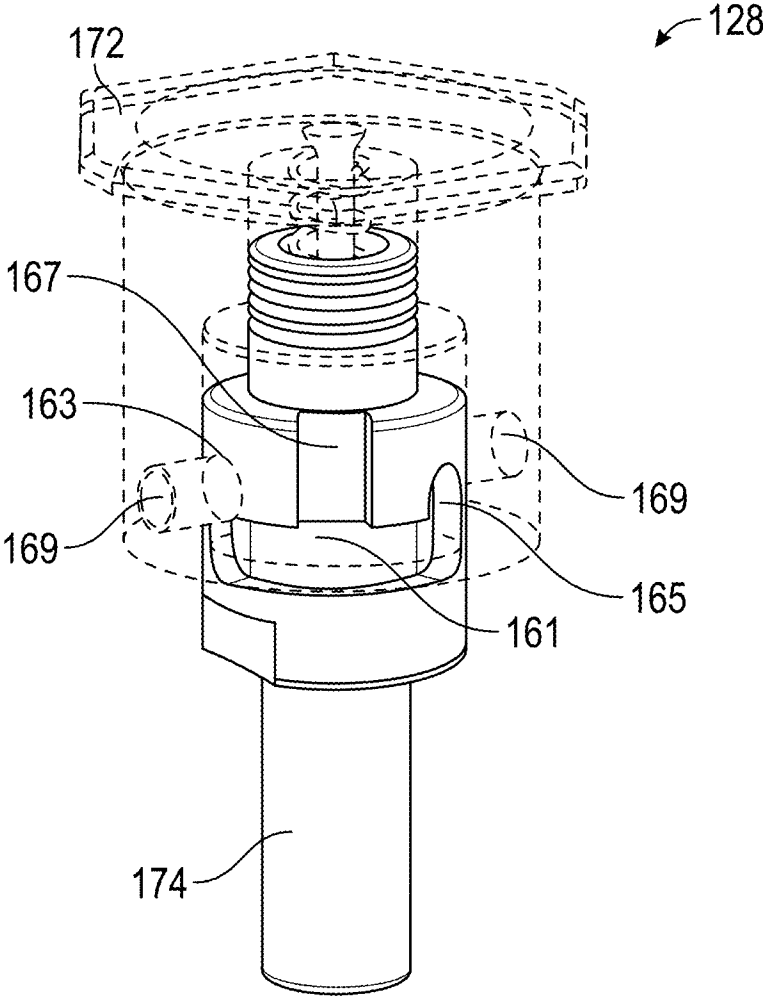
FIG. 29 is another perspective view of the multi-position nozzle of FIG. 21.

In an arrangement of the multi-position nozzles 128, such as across the width of the cooling pad assembly 102, individual multi-position nozzles 128 may be selectively positioned in the base position and/or the offset position to provide a desired cooling profile. FIGS. 25 and 26 illustrate non-limiting examples of arrangements of three multi-position nozzles 128D-F providing different cooling profiles. The arrangements 2500 and 2600, are provided for illustrative purposes only, and various other arrangements of multi-position nozzles 128 may be utilized in the second nozzle arrangement 124.

In the arrangement 2500 of FIG. 25, each of the nozzles 128D-F is in the same position (e.g., the base position) to provide uniform cooling across the arrangement 2500. As illustrated in FIG. 25, the position indicators 186 may provide a visual indication that all of the nozzles 128D-F are in the same position because all of the position indicators 186 have the same orientation relative to the casting direction 110. In the example of FIG. 25, the position indicators 186 are all aligned to be substantially parallel to the casting direction 110.

In the arrangement 2600 of FIG. 26, two of the nozzles (e.g., nozzles 128D and 128F) are in the same position (e.g., the base position) while one of the nozzles (e.g., nozzle 128E) is at a different position (e.g., the offset position) such that the arrangement 2600 provides non-uniform cooling. In this example, the region corresponding to the nozzle 128E may provide reduced heat transfer relative to the other regions. As illustrated in FIG. 26, the position indicators 186 provide a visual indication that the nozzle 128E is in a different position than that of the nozzles 128D and 128F because the position indicators 186 of the nozzle 128E are offset by 60° and in a clockwise direction relative to the casting direction 110.

Illustrations

A collection of exemplary embodiments are provided below, including at least some explicitly enumerated as "Illustrations" providing additional description of a variety of example embodiments in accordance with the concepts described herein. These illustrations are not meant to be mutually exclusive, exhaustive, or restrictive; and the disclosure not limited to these example illustrations but rather encompasses all possible modifications and variations within the scope of the issued claims and their equivalents.

Illustration 1. A cooling pad assembly for a belt casting system, the cooling pad assembly comprising: an elongated nozzle assembly comprising: a base defining a receiving area; a first insert positionable within the receiving area, wherein the first insert and the base together define a first elongated dispensing slot; and a second insert positionable within the receiving area, wherein the second insert and the base together define a second elongated dispensing slot that is offset from the first elongated dispensing slot in a longitudinal direction, wherein the cooling pad is configured to dispense a coolant through each of the first elongated dispensing slot and the second elongated dispensing slot, and wherein the first insert is independently adjustable relative to the second insert within the receiving area.

Illustration 2. The cooling pad assembly of any preceding or subsequent illustrations or combination of illustrations, wherein the first insert and the second insert together define an elongated drainage slot between the first elongated dispensing slot and the second elongated dispensing slot in the longitudinal direction.

Illustration 2a. The cooling pad assembly of any preceding or subsequent illustrations or combination of illustrations, wherein the first elongated dispensing slot is perpendicular to a process path line direction.

Illustration 3. The cooling pad assembly of any preceding or subsequent illustrations or combination of illustrations, wherein: the base defines a first plurality of dispensing apertures, a second plurality of dispensing aperture, and a plurality of drainage apertures; the plurality of drainage apertures are provided between the first plurality of dispensing apertures and the second plurality of dispensing apertures; and each drainage aperture of the plurality of drainage apertures is longitudinally offset from a corresponding dispensing aperture of the first plurality of dispensing apertures and from a corresponding dispensing aperture of the second plurality of dispensing apertures.

Illustration 4. The cooling pad assembly of any preceding or subsequent illustrations or combination of illustrations, wherein the first plurality of dispensing apertures are longitudinally aligned with the second plurality of dispensing apertures.

Illustration 5. The cooling pad assembly of any preceding or subsequent illustrations or combination of illustrations, wherein: the first insert and the second insert together define an elongated drainage slot between the first elongated dispensing slot and the second elongated dispensing slot in the lateral direction; the first insert comprises a plurality of first insert apertures that are in fluid communication with the first plurality of dispensing apertures; the second insert comprises a plurality of second insert apertures that are in fluid communication with the second plurality of dispensing apertures; and the elongated drainage slot is in fluid communication with the plurality of drainage apertures.

Illustration 6. The cooling pad assembly v, further comprising a support assembly, wherein the elongated nozzle assembly is supported on the support assembly.

Illustration 7. The cooling pad assembly of any preceding or subsequent illustrations or combination of illustrations, wherein the elongated nozzle assembly is a first elongated nozzle assembly, and wherein the cooling pad further comprises a second elongated nozzle assembly supported on the support assembly downstream from the first elongated nozzle assembly.

Illustration 8. The cooling pad assembly of any preceding or subsequent illustrations or combination of illustrations, further comprising a plurality of multi-position nozzles supported on the support assembly downstream from the elongated nozzle assembly, wherein each multi-position nozzle of the plurality of multi-position nozzles is movable between a base position and an offset position.

Illustration 9. The cooling pad assembly of any preceding or subsequent illustrations or combination of illustrations, wherein the first insert and the second insert together define an elongated drainage slot between the first elongated dispensing slot and the second elongated dispensing slot in the longitudinal direction, and wherein the support assembly comprises: a chamber configured to store a supply of the coolant; a plurality of supply passages in fluid communication with the chamber and extending in a vertical direction, wherein at least one supply passage of the plurality of supply passages is in fluid communication with the first elongated dispensing slot, and wherein at least one other supply passage of the plurality of supply passages is in fluid communication with the second elongated dispensing slot; and a plurality of drainage passages in fluid communication with the elongated drainage slot and extending in the vertical direction, wherein each drainage passage of the plurality of drainage passages is longitudinally and laterally offset from an adjacent supply passage of the plurality of supply passages.

Illustration 10. The cooling pad assembly of any preceding or subsequent illustrations or combination of illustrations, wherein the support further comprises a drainage channel extending in a horizontal direction and intersecting at least two drainage passages of the plurality of drainage passages such that the drainage channel and at least two drainage passages are in fluid communication.

Illustration 11. A method of assembling the cooling pad assembly of any preceding or subsequent illustrations or combination of illustrations, the method comprising: positioning the first insert within the receiving area and securing the first insert relative to the base such that the first elongated dispensing slot has a desired dimension; and positioning the second insert within the receiving area and securing the second insert relative to the base such that the second elongated dispensing slot has a desired dimension.

Illustration 12. The method of any preceding or subsequent illustrations or combination of illustrations, wherein positioning the second insert comprises positioning the second insert within the receiving area relative to the first insert such that an elongated drainage slot defined by the first insert and the second insert has a desired dimension.

Illustration 13. A cooling pad assembly for a belt casting system, the cooling pad assembly comprising: a nozzle arrangement comprising a plurality of multi-position nozzles configured to dispense a coolant, wherein each multi-position nozzle comprises a stem and a cap that is rotatably and longitudinally movable along the stem between a base position and an offset position, wherein the cap comprises a dispensing end, and wherein: in the base position, the dispensing end is arranged in a cooling pad nozzle plane relative to a central plane of a casting cavity of the belt casting system; and in the offset position, the dispensing end is offset by a distance from the cooling pad nozzle plane and away from the central plane.

Illustration 14. The cooling pad assembly of any preceding or subsequent illustrations or combination of illustrations, wherein the distance is from 0.1 mm to 2.0 mm.

Illustration 15. The cooling pad assembly of any preceding or subsequent illustrations or combination of illustrations, wherein the distance is 1.0 mm.

Illustration 16. The cooling pad assembly of any preceding or subsequent illustrations or combination of illustrations, wherein the nozzle arrangement is a first nozzle arrangement, wherein the cooling pad further comprises a second nozzle arrangement upstream from the first nozzle arrangement and comprising an elongated nozzle assembly, the elongated nozzle assembly comprising: a base defining a receiving area; a first insert positionable within the receiving area, wherein the first insert and the base together define a first elongated dispensing slot; and a second insert positionable within the receiving area, wherein the second insert and the base together define a second elongated dispensing slot that is offset from the first elongated dispensing slot in a longitudinal direction, wherein the cooling pad is configured to dispense a coolant through each of the first elongated dispensing slot and the second elongated dispensing slot, and wherein the first insert is independently adjustable relative to the second insert within the receiving area.

Illustration 17. The cooling pad assembly of any preceding or subsequent illustrations or combination of illustrations, wherein the dispensing end of each multi-position nozzle comprises a plurality of edges forming a hexagonal perimeter and such that the dispensing end comprises a hexagonal face, and wherein an intersection of two edges of the plurality of edges comprises a position indicator.

Illustration 18. The cooling pad assembly of any preceding or subsequent illustrations or combination of illustrations, wherein across a width of the cooling pad that is transverse to a casting direction, at least one multi-position nozzle is in the base position and at least one multi-position nozzle is in the offset position.

Illustration 19. A method of continuously casting a metal product with the cooling pad assembly of any preceding or subsequent illustrations or combination of illustrations, the method comprising: continuously introducing molten metal into an inlet of a casting cavity defined between spaced apart confronting casting surfaces advancing in a casting direction, wherein each casting surface is a first surface of an endless belt; continuously discharging the metal product from the casting cavity through an outlet of the casting cavity; and controlling the cooling pad such that at least one casting surface comprises a non-uniform heat transfer profile across a width of the at least one casting surface.

Illustration 20. The method of any preceding or subsequent illustrations or combination of illustrations, wherein controlling the cooling pad assembly comprises positioning at least one multi-position nozzle of the plurality of multi-position nozzles in the base position and at least one multi-position nozzle of the plurality of multi-position nozzles in the offset position relative to a surface of the endless belt opposite from the casting surface.

Illustration 21. The method of any preceding or subsequent illustrations or combination of illustrations, wherein controlling the cooling pad assembly comprises changing at least one multi-position nozzle of the plurality of multi-position nozzles from the base position to the offset position, and wherein changing the at least one multi-position nozzle comprises rotating the cap relative to the stem by a predetermined angle and vertically moving the cap along the stem.

Illustration 22. The method of any preceding or subsequent illustrations or combination of illustrations, wherein the predetermined angle is from greater than 0° to 90°.

Illustration 23. The method of any preceding or subsequent illustrations or combination of illustrations, wherein the predetermined angle is 60°.

Illustration 24. A cooling pad assembly for a belt casting system, the cooling pad assembly comprising: a support assembly comprising: a chamber configured to store a supply of a coolant; a plurality of supply passages in fluid communication with the chamber and extending in a vertical direction; and a plurality of drainage passages extending in the vertical direction, wherein each drainage passage of the plurality of drainage passages is longitudinally and laterally offset from an adjacent supply passage of the plurality of supply passages; and a nozzle arrangement supported on the support assembly and comprising at least one dispensing aperture and at least one drainage aperture, wherein the at least one dispensing aperture is in fluid communication with at least one supply passage of the plurality of supply passages, and wherein the at least one drainage aperture is in fluid communication with at least one drainage passage of the plurality of drainage passages.

Illustration 25. The cooling pad assembly of any preceding or subsequent illustrations or combination of illustrations, wherein the support assembly further comprises a drainage channel extending in a lateral direction and intersecting at least two drainage passages of the plurality of drainage passages such that the drainage channel and at least two drainage passages are in fluid communication and such that the at least one drainage aperture is in fluid communication with at least two drainage passages.

Illustration 26. The cooling pad assembly of any preceding or subsequent illustrations or combination of illustrations, wherein the nozzle arrangement is a first nozzle arrangement, and wherein the cooling pad further comprises a second nozzle arrangement downstream from the first nozzle arrangement, the second nozzle arrangement comprising a plurality of multi-position nozzles supported on the support assembly downstream from the first nozzle arrangement, wherein each multi-position nozzle of the plurality of multi-position nozzles is movable between a base position and an offset position.

Illustration 27. The cooling pad assembly of any preceding or subsequent illustrations or combination of illustrations, wherein the at least one dispensing aperture is a first elongated dispensing slot, wherein the at least one drainage aperture is an elongated drainage slot, wherein the nozzle arrangement further comprises an elongated nozzle assembly, the elongated nozzle assembly comprising: a base defining a receiving area; a first insert positionable within the receiving area, wherein the first insert and the base together define the first elongated dispensing slot; and a second insert positionable within the receiving area, wherein the second insert and the base together define a second elongated dispensing slot that is offset from the first elongated dispensing slot in a longitudinal direction, wherein the first insert and the second insert together define an elongated drainage slot between the first elongated dispensing slot and the second elongated dispensing slot in the longitudinal direction, wherein the cooling pad is configured to dispense a coolant through each of the first elongated dispensing slot and the second elongated dispensing slot, and wherein the first insert is independently adjustable relative to the second insert within the receiving area.

Illustration 28. The cooling pad assembly of any preceding or subsequent illustrations or combination of illustrations, wherein the support assembly further comprises a side port providing access to the chamber and a side cap configured to selectively seal the side port.

Illustration 29. The cooling pad assembly of any preceding or subsequent illustrations or combination of illustrations, wherein the support assembly is a first module, and wherein the support comprises a plurality of modules such that a length of the cooling pad assembly is adjustable.

Illustration 30. The cooling pad assembly of any preceding or subsequent illustrations or combination of illustrations, wherein each module comprises a chamber, a plurality of supply passages, and a plurality of drainage passages.

Illustration 31. The cooling pad assembly of any preceding or subsequent illustrations or combination of illustrations, wherein the nozzle arrangement is a first nozzle arrangement, and wherein the cooling pad further comprises a second nozzle arrangement downstream from the first nozzle arrangement, the second nozzle arrangement comprising a plurality of multi-position nozzles supported on the support assembly downstream from the first nozzle arrangement, wherein each multi-position nozzle of the plurality of multi-position nozzles is movable between a plurality of positions, wherein a height of one position of the plurality of positions is offset from a height of another position of the plurality of positions.

The above-described aspects are merely possible examples of implementations, merely set forth for a clear understanding of the principles of the present disclosure.

Many variations and modifications can be made to the above-described embodiment(s) without departing substantially from the spirit and principles of the present disclosure. All such modifications and variations are intended to be included herein within the scope of the present disclosure, and all possible claims to individual aspects or combinations of elements or steps are intended to be supported by the present disclosure. Moreover, although specific terms are employed herein, as well as in the claims that follow, they are used only in a generic and descriptive sense, and not for the purposes of limiting the described embodiments, nor the claims that follow.

That which is claimed:

1. A cooling pad assembly for a belt casting system, the cooling pad assembly comprising:

a nozzle arrangement comprising a plurality of multi-position nozzles configured to dispense a coolant, wherein each multi-position nozzle comprises a stem and a cap that is rotatably and longitudinally movable along the stem between a base position and an offset position, wherein the cap comprises a dispensing end, and wherein:

in the base position, the dispensing end is arranged in a cooling pad nozzle plane relative to a central plane of a casting cavity of the belt casting system; and in the offset position, the dispensing end is offset by a distance from the cooling pad nozzle plane and away from the central plane.

2. The cooling pad assembly of claim 1, wherein the distance is from 0.1 mm to 2.0 mm.

3. The cooling pad assembly of claim 1, wherein the nozzle arrangement is a first nozzle arrangement, wherein the cooling pad further comprises a second nozzle arrangement upstream from the first nozzle arrangement and comprising an elongated nozzle assembly, the elongated nozzle assembly comprising:

a base defining a receiving area;

a first insert positionable within the receiving area, wherein the first insert and the base together define a first elongated dispensing slot; and a second insert positionable within the receiving area, wherein the second insert and the base together define a second elongated dispensing slot that is offset from the first elongated dispensing slot in a longitudinal direction, wherein the cooling pad is configured to dispense a coolant through each of the first elongated dispensing slot and the second elongated dispensing slot, and wherein the first insert is independently adjustable relative to the second insert within the receiving area.

4. The cooling pad assembly of claim 1, wherein the dispensing end of each multi-position nozzle comprises a plurality of edges forming a hexagonal perimeter and such that the dispensing end comprises a hexagonal face, and wherein an intersection of two edges of the plurality of edges comprises a position indicator.

5. The cooling pad assembly of claim 1, wherein across a width of the cooling pad that is transverse to a casting direction, at least one multi-position nozzle is in the base position and at least one multi-position nozzle is in the offset position.

* * * * *